US011839302B2

(12) United States Patent
Farnsworth et al.

(10) Patent No.: US 11,839,302 B2
(45) Date of Patent: Dec. 12, 2023

(54) TABLE WITH FLOATING PERIMETER SUPPORT

(71) Applicant: Mity-Lite, Inc., Orem, UT (US)

(72) Inventors: Orrin C Farnsworth, Santaquin, UT (US); Austin T. Farnsworth, Orem, UT (US); Matthew S. Pectol, Provo, UT (US); Jordan D. Lundell, Orem, UT (US); Aaron Barker, Orem, UT (US); Mitchell V. Heath, Orem, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 17/691,760

(22) Filed: Mar. 10, 2022

(65) Prior Publication Data

US 2023/0148752 A1 May 18, 2023

Related U.S. Application Data

(60) Provisional application No. 63/278,841, filed on Nov. 12, 2021.

(51) Int. Cl.

| | |
|---|---|
| ***A47B 96/20*** | (2006.01) |
| ***A47B 96/18*** | (2006.01) |
| ***A47B 3/08*** | (2006.01) |
| ***A47B 13/08*** | (2006.01) |

(52) U.S. Cl.

CPC ..... *A47B 96/206* (2013.01); *A47B 3/08* (2013.01); *A47B 13/083* (2013.01); *A47B 96/18* (2013.01)

(58) Field of Classification Search

CPC ..... A47B 96/206; A47B 3/08; A47B 13/08; A47B 13/083; A47B 13/02; A47B 13/086

See application file for complete search history.

(56) References Cited

U.S. PATENT DOCUMENTS

| | | | | |
|---|---|---|---|---|
| 3,676,279 | A * | 7/1972 | Beaver | B32B 3/12 52/782.2 |
| 5,173,348 | A * | 12/1992 | Gevaert | A47B 13/083 52/782.2 |
| 5,436,048 | A * | 7/1995 | Meier | A47B 95/043 52/800.1 |
| 7,707,949 | B2 * | 5/2010 | Larcom | A47B 3/0916 108/174 |
| 9,504,314 | B2 * | 11/2016 | Leng | A47B 3/087 |
| 11,140,986 | B2 * | 10/2021 | Leng | F16B 5/0004 |
| 2005/0223951 | A1 * | 10/2005 | Leng | A47B 13/08 108/27 |

(Continued)

*Primary Examiner* — Daniel J Rohrhoff

(74) *Attorney, Agent, or Firm* — Thorpe North & Western, LLP

(57) ABSTRACT

A banquet table comprises a laminate tabletop with a high-pressure solid composite laminate of paper impregnated with resin. A hoop carries a perimeter of the tabletop and has a perimeter with a size and a shape substantially matching a size and a shape of a perimeter of the tabletop. Elongated runners carry an interior of the tabletop. Legs are coupled to the runners and extend to elevate the tabletop thereon. A polymer trim surrounds the perimeter of the hoop. The trim has a vertical height substantially the same as a vertical thickness of the hoop, with the tabletop extending above a height of the trim so that the tabletop has an exposed perimeter edge. The trim has a horizontal thickness extending laterally beyond the tabletop.

20 Claims, 17 Drawing Sheets

(56) References Cited

U.S. PATENT DOCUMENTS

| | | | | |
|---|---|---|---|---|
| 2006/0236902 | A1* | 10/2006 | Haney | A47B 13/08 108/115 |
| 2014/0184037 | A1* | 7/2014 | Sidoti | A47B 96/201 29/525.13 |
| 2018/0199706 | A1* | 7/2018 | Leng | A47B 13/083 |
| 2020/0170405 | A1* | 6/2020 | Grabowski | A47B 13/02 |
| 2021/0127826 | A1* | 5/2021 | Krämer | B32B 9/045 |
| 2021/0204687 | A1* | 7/2021 | Haase | A47B 13/08 |
| 2022/0161539 | A1* | 5/2022 | Clement | B32B 5/022 |

* cited by examiner

TABLE WITH FLOATING PERIMETER SUPPORT

PRIORITY CLAIM(S) AND RELATED APPLICATION(S)

Priority is claimed to U.S. Provisional Patent Application Ser. No. 63/278,841, filed, Nov. 12, 2021, which is hereby incorporated herein by reference.

BACKGROUND

Banquet tables are used in the event and hospitality industry for hosting large gatherings. The banquet tables can be robust for repeatedly handling, movement and storage. For example, the tables can have a wood substrate and/or a wood support frame. As such, the banquet tables can be heavy. In addition, the structure of many banquet tables dictates in-door use and cannot weather adverse conditions, such as sunlight and moisture. Some tables can be round. The manufacture of round tables can be difficult. The development of banquet tables is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
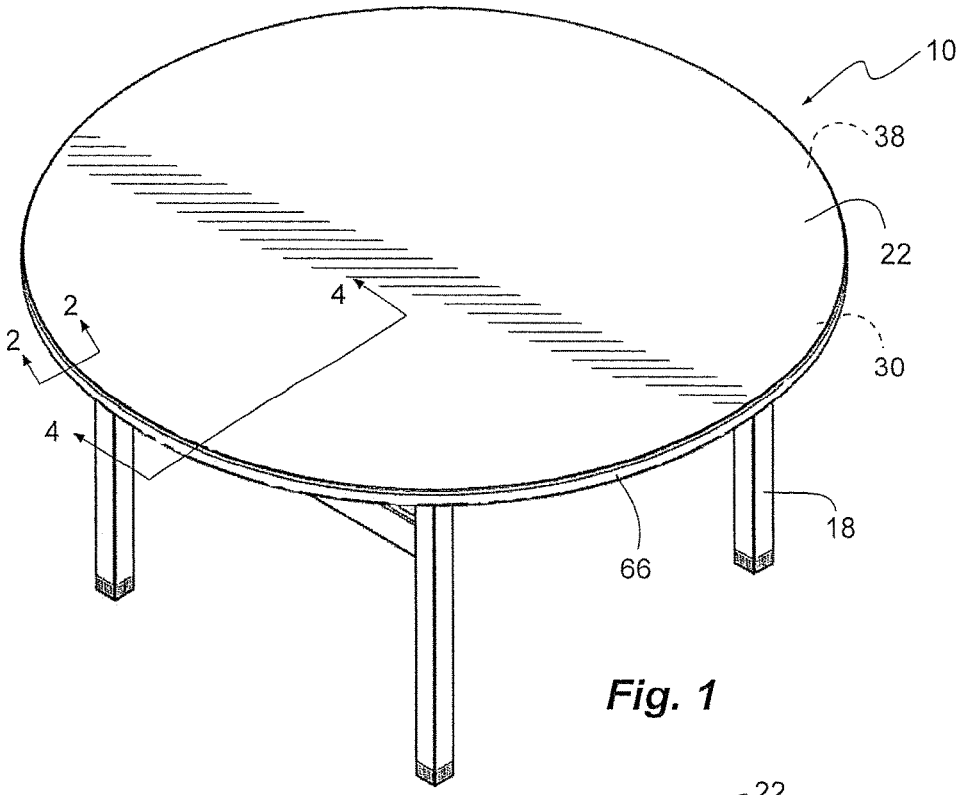
FIG. 1 is a perspective view of a circular banquet table in accordance with an embodiment of the invention.
Figure 2:
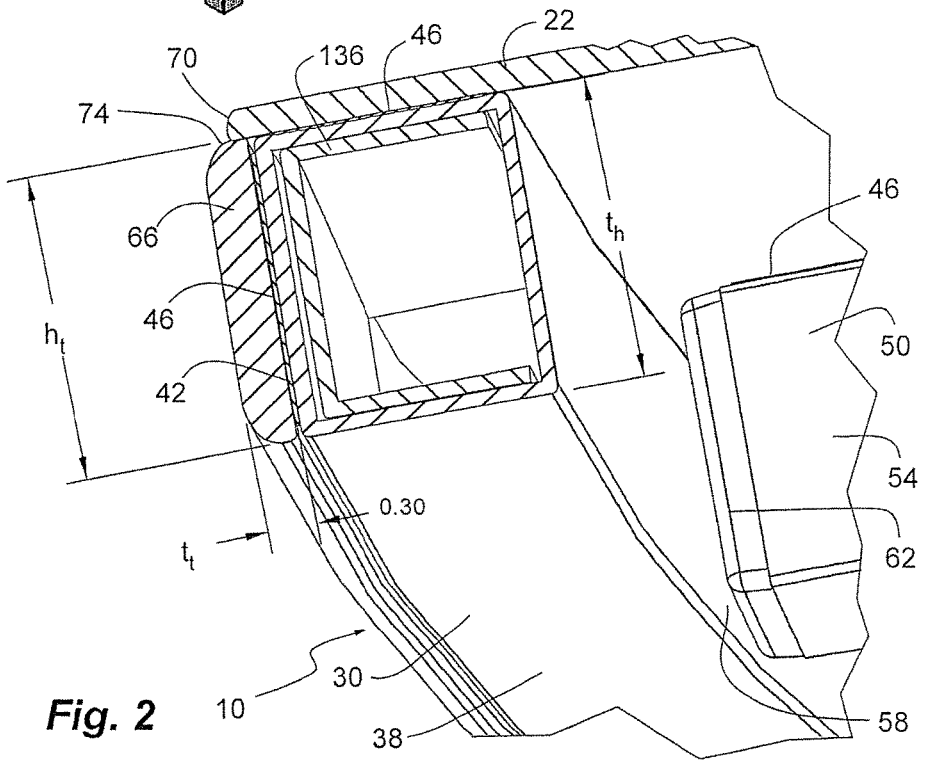
FIG. 2 is a detailed partial cross-sectional view of the banquet table of FIG. 1 taken along line 2 of FIG. 1.
Figure 3:
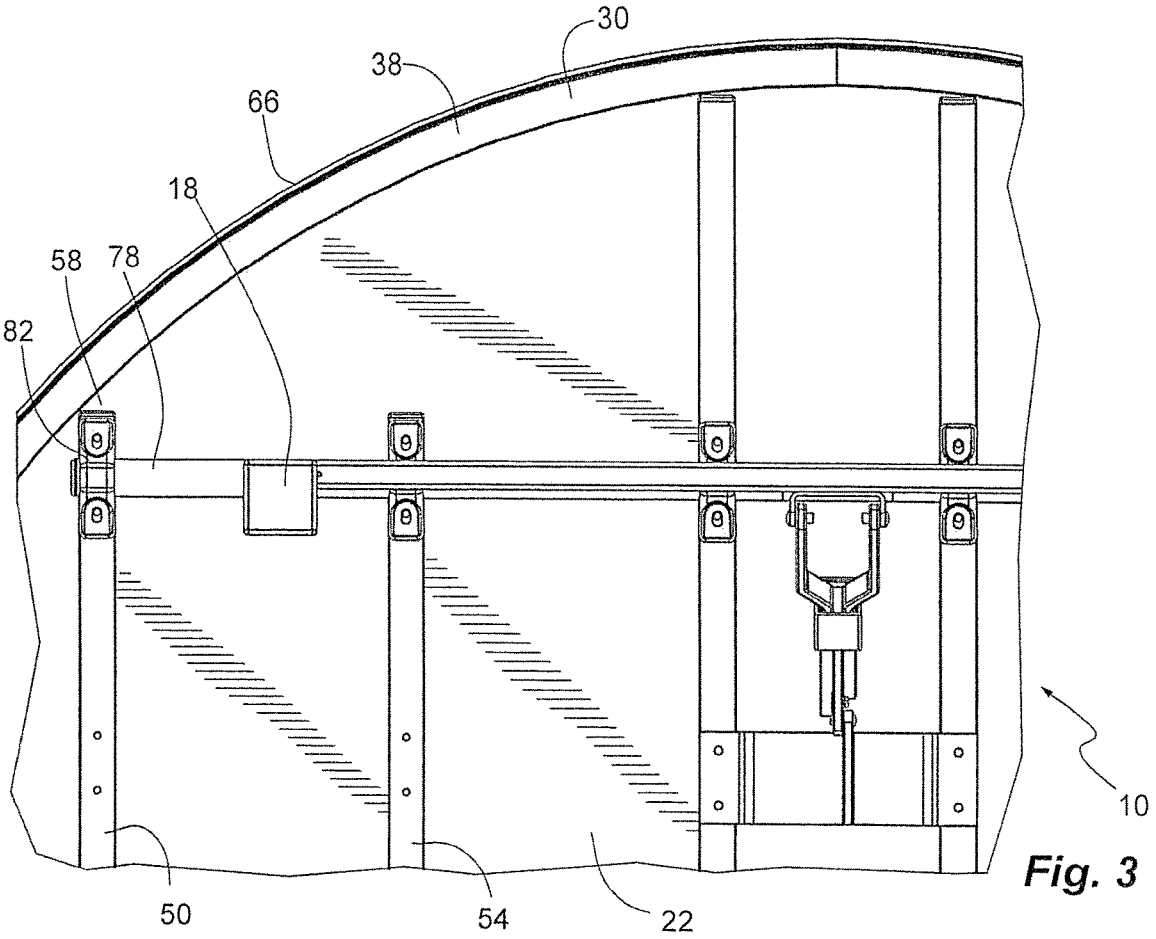
FIG. 3 is a partial bottom view of the banquet table of FIG. 1.
Figure 4:
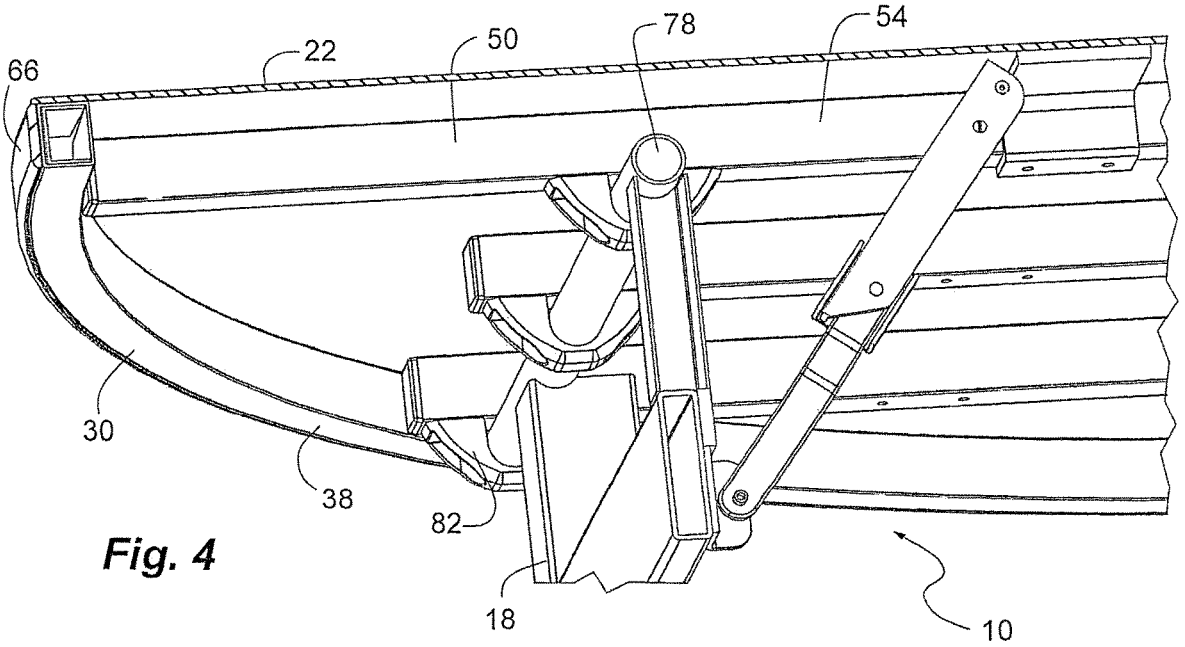
FIG. 4 is a partial cross-sectional view of the banquet table of FIG. 1 taken along line 4 of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

The term "banquet table" is used herein, unless otherwise specified, to refer to a commercial grade table. The banquet table can be structured for repeated handling, such as set-up and take down, and repeated movement, such as placement and reconfiguration. The banquet table can also have folding legs so that the table can be stored compactly when not in use.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

Banquet Table

Banquet tables used in event and hospitality industries are often constructed of heavy duty, and heavy, materials. For example, a banquet table can have a plastic tabletop laminated to and supported by a solid wood substrate. The substrate can be continuous across the entire plastic tabletop. The substrate in turn can be supported by a wood or metal framework. Overall, the tables can be heavy and difficult to handle. In addition, the tables are intended for indoor use due to the use of a wood substrate. Outdoor use of the tables can subject them to moisture, and potential ruin. While lighter, blow molded tables have been proposed with a blow molded table supported by a metal frame, such tables are not seriously considered for use in industry due to their weak and frail materials and construction.

The banquet tables of the invention provide a lighter-weight construction by utilizing a thin, high-pressure laminate without a supporting substrate as the tabletop. Separate outer and inner frames can be coupled underneath and directly to the tabletop to support the thin laminate. It has been discovered that the separate outer and inner frames provide sufficient support while eliminating extensive joining or welding operations for forming a unified frame.

The laminate of the tabletop can be a high-pressure solid composite of paper impregnated with resin. It has been found that the high-pressure laminate provides sufficient weatherability to both sunlight and moisture while eliminating the weight and poor weatherability of wood. Thus, the banquet table can be utilized outdoors for extended periods and during inclement weather. In addition, it has been found that the high-pressure laminate, without a supporting structural substrate, provides sufficient strength and rigidity, with the separate outer and inner frames.

Figure 5:
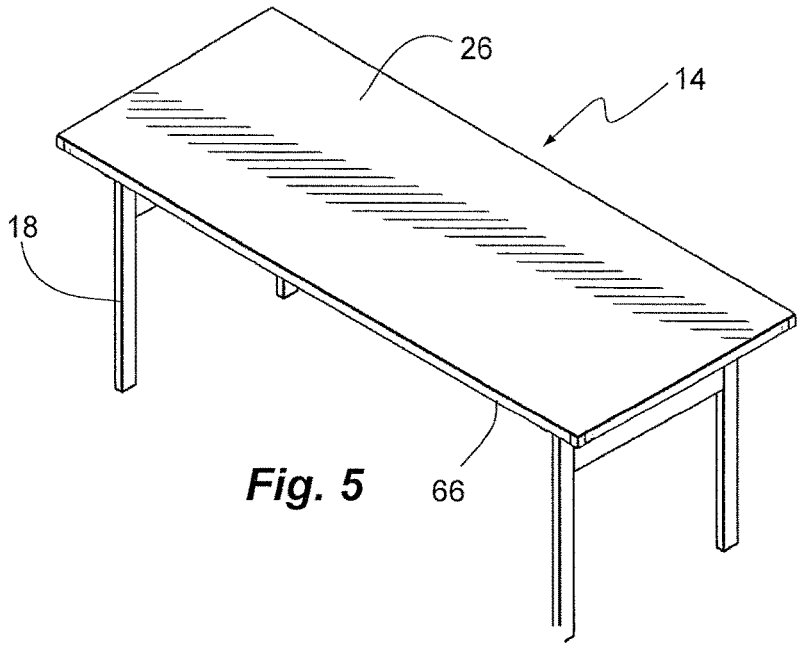
FIG. 5 is a perspective view of a rectangular banquet table in accordance with an embodiment of the invention.
Figure 6:
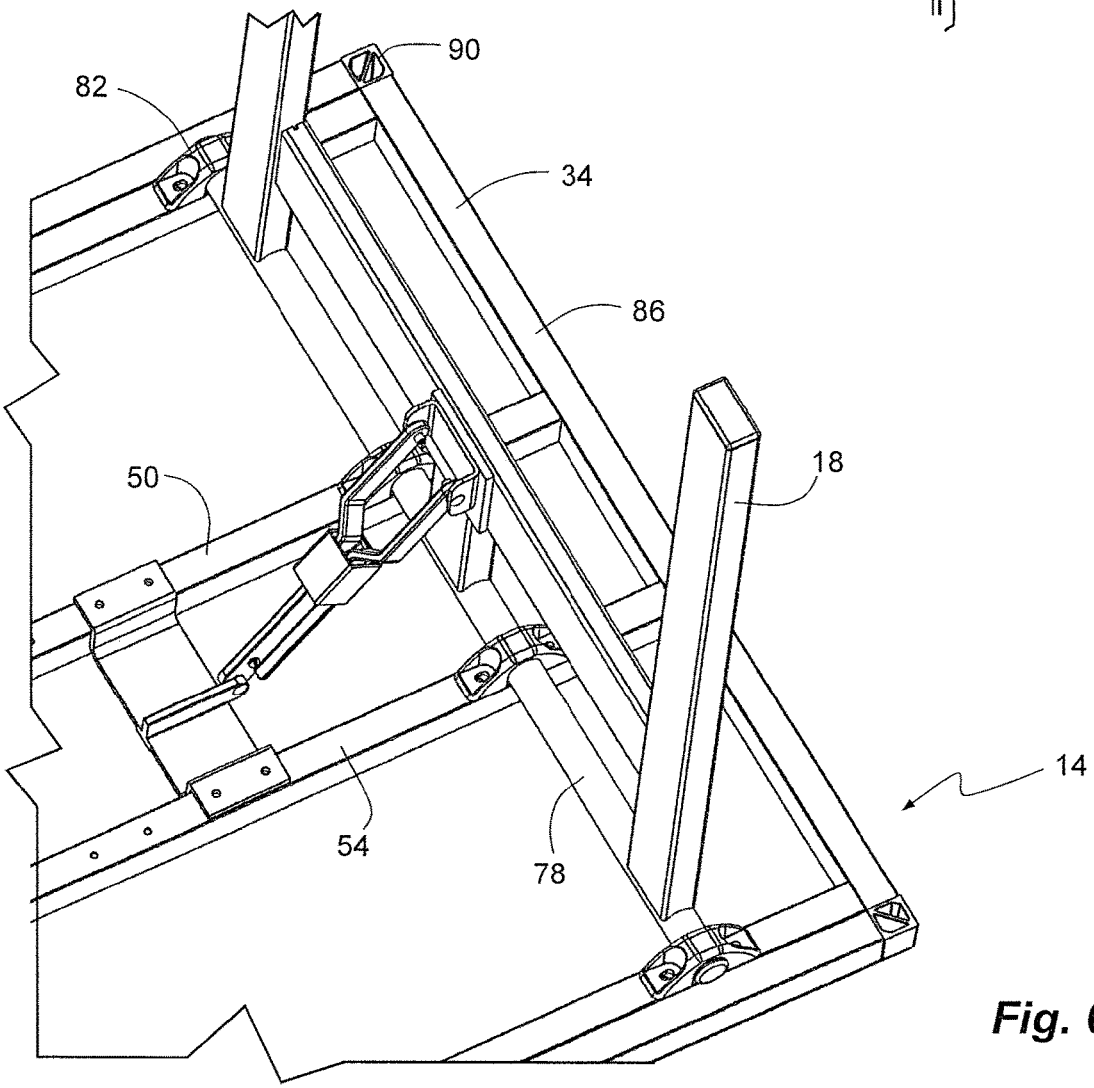
FIG. 6 is a partial bottom perspective view of the banquet table of FIG. 5.

Referring to FIGS. 1-6, banquet tables 10 and 14 in accordance with examples of the invention are shown. In one aspect, the table 10 can be circular, as shown in FIGS. 1-4. In another aspect, the table 14 can be rectangular with four sides and four right angles, as shown in FIGS. 5 and 6. The circular and rectangular tables 10 and 14 are shown by way of example. In another aspect, the table can be other shapes, such as polygonal, semi-circular, etc. The circular table 10 can have a diameter of approximately: 72 inches in one aspect; 66 inches in another aspect; 60 inches in another aspect; 48 inches in another aspect; 36 inches in another aspect; and 30 inches in another aspect. The rectangular table 14 can have a width of approximately 30 inches in one aspect; and different lengths, such as 72 inches in one aspect. The tables 10 and 14 have legs 18 that can be foldable and lockable. The legs 18 can be paired together so that the pairs fold and lock together. Various aspects of foldable and lockable legs are described in U.S. Pat. No. 8,550,012, which is hereby incorporated herein by reference. The legs 18 can be formed of metal, such as aluminum tubing that is cut and welded together, and powder coated.

The tables 10 and 14 have tabletops 22 and 26, respectively. As described above, the tabletops can be circular tabletops 22, rectangular tabletops 26, or other shapes. The tables 10 and 14 and the tabletops 22 and 26 will be described with respect to the circular table 10 and the circular tabletop 22, with an understanding that the rectangular table 14 and the rectangular tabletop 26 have similar construction. The tabletop 22 can be a laminate tabletop with a high-pressure solid composite laminate of paper impregnated with resin. The composite laminate can comprise decorative surface paper impregnated with melamine resin over kraft paper core sheets impregnated with phenolic resin. The tabletop 22 and the laminate can be thin and can have a thickness no greater than: ⅜ inch (9.5 mm) in one aspect; 5⁄16 inch (8 mm) in another aspect; ¼ inch (6.3 mm) in another aspect; 3⁄16 inch (4.8 mm) another aspect; and ⅛ inch (3.2 mm) in another aspect. As described above, the thinness of the tabletop 22 and the laminate can reduce the weight of the table 10. The solid composite laminate can also provide a strong tabletop 22 without the need for a structural substrate or backing for the laminate, again reducing the weight of the table 10. Also as described above, banquet tables are frequently reconfigured, stored and retrieved, making weight of the table 10 an issue. The tabletop 22 can have a planar top surface and a planar bottom surface with the thickness being constant across substantially the entire tabletop 22, such as over a super-majority of greater than 95% thereof. In one aspect, the perimeter edges of the tabletop 22 and the laminate can have a bevel or a chamfer. Thus, the entire tabletop 22, except for the bevel or chamfer of the perimeter edge, can have a constant thickness. In another aspect, the tabletop 22 and the laminate can comprise an ultraviolent (UV) stabilizer mixed with the resin and the laminate to provide and define an outdoor banquet table 10.

An outer perimeter frame can carry a perimeter of the tabletop. A circular outer perimeter frame 30 can carry the perimeter of the circular tabletop 10 while a rectangular outer perimeter frame 34 can carry the perimeter of the rectangular tabletop 14. The outer perimeter frames 30 and 34 can comprise a circular hoop 38 or a rectangular hoop 86, respectively. The tables 10 and 14 and the circular and rectangular outer perimeter frames 30 and 34 will be described with respect to the circular table 10 and the circular outer perimeter frame 30, with an understanding that the rectangular table 14 and the rectangular outer perimeter frame 34 have a similar construction.

The circular outer perimeter frame 30 can have a perimeter with a size and a shape substantially matching a size and a shape of a perimeter of the circular tabletop 22. In one aspect, the perimeters of the outer perimeter frame 30 and the tabletop 22 can be the same accounting for manufacturing tolerances. In another aspect, the tabletop 22 can be slightly oversized with an overhang of approximately 3⁄32 inches (1 mm) around the perimeter. The outer perimeter frame 30 and the hoop 38 can comprise an aluminum tube with a rectangular cross-sectional shape (radially therethrough or perpendicular to a length thereof) with a flat upper surface facing an underside of the tabletop 22 and a vertically straight outer surface 42. The vertical orientation is references to a use configuration of the table 10 with the tabletop 22 in a horizontal orientation. In another aspect, the hoop 38 and the tube can be uncoated to save on manufacturing costs. As described above, the hoop can be circular for the circular table 10, rectangular for the rectangular table 14, or another shape matching the shape of other tables and tabletops.

The tabletop 22, the hoop 38 and the outer perimeter frame 34 can be attached together. In one aspect, the tabletop 22 can be attached to the hoop 38 with double-sided tape 46 between the underside of the tabletop 22 and the flat upper surface of the tube of the hoop 38. In another aspect, an adhesive can be used. The hoop 38 may be characterized as being directly affixed to the underside of the tabletop 22, even with the intervening double-sided tape 46, because there is no intervening structure member between the two, such as a substrate.

An inner frame 50 carries an interior of the tabletop 22 and 26. The inner frame 50 can comprise an array of elongated runners 54 spaced-apart across the interior of the tabletop 22 and 26. In one aspect, the runners 54 can have different lengths for the circular tabletop 22. In another aspect, the runners 54 can have the same length for the rectangular tabletop 26. The elongated runners 54 can comprise aluminum tube with a rectangular cross-sectional shape (perpendicular to a length thereof) with a flat upper surface facing the underside of the tabletop 22 and 26. The tabletop 22 and 26, the runners 54 and the inner frame 50 can be attached together. In one aspect, the underside of the tabletop 22 and 26 can be attached to the runners 54 with double-sided tape 46 between the underside of the tabletop 22 and 26 and the flat upper surface of the tube of the runners 54. Again, the runners 54 may be characterized as being directly affixed to the underside of the tabletop 22, even with the intervening double-sided tape 46, because there is no intervening structure member between the two, such as a substrate.

In one aspect, the outer perimeter frame 30 or 34 and the inner frame 50 can be separate and distinct from one another, and uncoupled from one another. For example, distal ends of the runners 54 can be separate and discrete with respect to the hoop 38 and uncoupled from the hoop 38. In another aspect, the inner frame 50 and the runners 54, and the outer perimeter frame 30 or 34 and the hoop 38, can be separated from one another and in a non-contact relationship, with an annular gap 58 (not necessarily circular) between the inner frame 50 and the outer perimeter frame 30 or 34. Thus, the inner frame 50 and the runners 54 thereof, and the outer perimeter frame 30 or 34 and the hoop 38 or 86 thereof, do not need to be attached or welded together, saving on manufacturing costs. The separate outer perimeter frame 30 or 34 and the hoop 38 can be floating with respect to the inner frame 50 and the runners 54. The open ends of the tubes of the runners 54 can be closed by plugs 62 that can further separate the inner frame 50 and the runners 54 thereof from the outer perimeter frame 30 or 34 and the hoop 38 thereof. In one aspect, the distal ends of the runners 54 and/or the plugs 62 thereof can abut to the hoop 38, but without being attached to the hoop 38. It has been found that the tabletop 22 or 26 is sufficiently strong with the floating hoop 38 or 86 and the separate runners 54 without the added expense and difficulty of attaching or welding the distal ends of the runners 54 to the hoop 38 or 86.

A trim 66 can surround and circumscribe the perimeter of the hoop 38. The trim 66 can have a vertical height $H_t$ substantially the same as a vertical thickness to of the hoop 38. The trim 66 can cover the vertically straight outer surface 42 of the hoop 38. Thus, the trim 66 can cover the lateral side of the hoop 38 and can provide a finished look. In another aspect, the tabletop 22 or 26 can extend above a height of the trim 66 so that the tabletop 22 or 26 has an exposed perimeter edge 70. In another aspect, the perimeter edge of the tabletop 22 or 26 can overlap the trim 66, as shown. Thus, the tabletop 22 or 26 resists having a vertical gap that can accumulate crumbs and debris. As described above, the tabletop 22 or 26 can be exposed and flat, and without a turndown. The exposed perimeter edge 70 of can be beveled or chamfered for a finished look and to avoid sharp edges. The trim 66 can have an upper edge 74 and a horizontal thickness $t_t$ extending laterally beyond the tabletop 22 or 26. The trim 66 can define an outermost diameter of the table 10 or 14 and the tabletop 22 or 26 with a width/diameter greater than a width/diameter of the outer perimeter frame and hoop 38. Thus, the trim 66 can form a bumper and a rolling or dragging surface to contact the ground or other surfaces to protect the tabletop 22 or 26 when the table 10 or 14 is turned on its side. The trim 66 can formed of a polymer, such as PVC or vinyl, and can be formed by extrusion. In another aspect, the trim 66 can comprise an ultraviolent (UV) stabilizer to provide and define an outdoor banquet table 10. In another aspect, the trim 66 can be attached to the outer surface 42 of the hoop 38 with double-sided tape 46.

In one aspect, the legs 18 can be coupled to the inner frame 50 and the runners 54. The legs 18 extend from the inner frame 50 and the runners 54 to elevate the tabletop 22 or 26 thereon. In another aspect, the legs 18 can be pivotally coupled to the inner frame 50 and the runners 54 to define a foldable banquet table 10. The legs 18 can pivot between: 1) an extended position extending transvers to the inner frame 50 and the runners 54 and elevating the tabletop 22 or 26 for use; and 2) a retracted position proximate to the inner frame 50 and the runners 54 for storage.

In one aspect, the inner frame 50 and the legs 18 can comprise a pair of spaced-apart top leg bars 78 coupled to the runners 54 and oriented transverse to the runners 54. The runners 54 can be sandwiched between the tabletop 22 or 26 and the top leg bars 78. Thus, the top leg bars 78 can form part of the inner frame 50 to support the interior of the tabletop 22 and 26. As described above, the tabletop 22 or 26 and the inner frame 50 and the runners 54 are without a structural substrate between the laminate tabletop and the inner frame. The legs 18 can extend from the top leg bars 78.

In another aspect, the inner frame 50 and the legs 18 can further comprise brackets 82 pivotally attaching the pair of top leg bars 78 to the runners 54. The top leg bars 78 pivot in the brackets 82 and pivot with respect to the runners 54 to define the foldable banquet table 10.

As described above, the banquet table 10 and 14 can be an outdoor banquet table suitable for prolonged outdoor use and in inclement weather. The tabletop 22 and 26, the outer perimeter frame 30 and the hoop 38, the inner frame 50 and the runners 54, the legs 18, the trim 66 and the double-sided tape 46 can be waterproof. The tabletop 22 and 26 and the trim 66 can comprise an ultraviolet (UV) stabilizer. The UV stabilizer can be a retarder to resist degradation due to sun exposure.

As shown in FIGS. 1-4, the circular table 10 can have a circular tabletop 22 and a circular outer perimeter frame 30 with a circular hoop 38. As shown in FIGS. 5 and 6, the rectangular table 14 can have a rectangular tabletop 26 and a rectangular outer perimeter frame 34 with a rectangular hoop 86. In one aspect, the rectangular hoop 86 can be separate segments jointed together with corner pieces 90. The corner pieces 90 can have inserts that insert into the ends of the tubes of the segments of the hoop 86. In another aspect, the rectangular hoop 86 can be formed of a single tube cut and bent with the opposite ends joined together to form the rectangular hoop 86. In another aspect, the distal opposite ends of the runners 54 can abut to the hoop 86 without being joined together to save manufacturing costs.

Method and Jigs for Making Banquet Table

Method and Jig for Making Circular Hoop

As described above, the circular table 10 has the perimeter of the tabletop 22 supported by and carried by the circular hoop 38. The circular tabletop 22 can be cut from a sheet of the laminate material. The circular hoop 38 can be formed by tubing with a rectangular cross-sectional shape, such as from straight stock aluminum tubing. While the circular tabletop 22 can be cut with relatively good precision in both size and shape, it can be difficult to form a circular hoop 38 with the same precision, particular in larger diameters. A circular hoop 38 that does not match the size and/or shape of the circular tabletop 22 can result in a table 10 that is aesthetically displeasing. For example, mismatched circular tabletop 22 and hoop 38 can have uneven overhang of the tabletop 22, gaps between trim 66 and the tabletop 22 exposing the hoop 38, etc. A tabletop 22 that covers the hoop 38, and with tight tolerances between the two, removes the need to finish or powder coat the hoop 38, and reduces cost. In addition, a tabletop 22 that covers the hoop 38, and with tight tolerances between the two, can be aesthetically pleasing without a covering, and can be a linen-less banquet table 10.

Referring to FIGS. 7-16, a cutting-and-joining jig 100 for forming a component of the table, such as the circular hoop 38, is shown in one example. The jig 100 can be used to create the circular hoop 38 with sufficient tolerance in both size and shape. A substantial circle 38*b* (FIGS. 11 and 12) can be formed from straight rectangular tube stock with rectangular cross-section with opposite ends 104 (FIGS. 11 and 12) of the substantial circle extending beyond one another and overlapping the substantial circle. The substantial circle 38*b* can be an initial circular hoop with overlapping ends 104. The substantial circle 38*b* can be formed from the straight tube stock with a roll bender with the rollers set for the desired diameter. Such a roll bender can have three rollers with one of the rollers adjustably positioned with respect to the other two. The tube stock is passed through and between the rollers, imparting a curvature to the tube stock. Such a substantial circle 38*b* can be cut to length, and the ends joined to form a circular hoop; but may lack the desired shape and size tolerance. However, the jig 100 can receive the substantial circle 38*b* to form the circular hoop 38 with the desired shape and size tolerance, and to more closely match the tabletop 22.

The jig 100 can comprise a radial array of chucks 106 or fixtures to receive the component of the table 10, such as the substantial circle 38*b*. The array of chucks 106 can define a circle. The chucks 106 can be radially and selectively displaced to obtain a desired diameter of the circle, based on the size of the table 10. The chucks 106 can be carried by a radial array of carriages 108 movably carried on a radial array of rails 112. The carriages 108, and thus the chucks 106, can be selectively displaceable radially along the rails 108. The substantial circle 38*b* can be placed in the chucks 106, with the carriages 108 and the chucks 106 spaced radially outwardly to receive the substantial circle 38*b*.

Each chuck 106 can have a horizontal clamp 116 (FIGS. 8 and 15) and an actuator 120 to open and close the clamp 116, such as horizontally, to grasp and clamp the substantial circle 38*b*. The clamp 116 can have a stationary clamp, and a movable actuated clamp. The inner clamps can be positioned to define the circle and can have a convex arcuate face. In addition, a platform can be formed between the clamps 116 to receive a portion of the substantial circle 38*b*. The clamps 116 of the chucks 106 can be closed horizontally to grasp and clamp the substantial circle 38*b*. In one aspect, the clamps 116 can be sequentially closed from one side 124 of the circle to an opposite side 128 of the circle. The one side 124 of the circle can correspond to an intermediate or middle portion of the substantial circle 38*b* with respect to the opposite ends 104, while the opposite side 128 of the circle can correspond to the opposite ends 104 of the substantial circle 38*b*. Thus, the clamps 116 grasp the substantial circle 38*b* sequentially starting from an intermediate portion with an intermediate clamp to the opposite ends 104 with end clamps to form the substantial circle 38*b* in a desired shape and size without warping the substantial circle 38*b*.

The carriages 108, and thus the chucks 106, can also be simultaneously drawn radially inwardly to the desired diameter of the hoop 38 by the radial displacement mechanism described below.

The jig 100 can also hold the substantial circle 38*b* while it is cut to for the hoop 38, and can cut the substantial circle 38*b*. A cutter 132 can be associated with one of the carriages 108*b* to cut the substantial circle 38*b*. In one aspect, the cutter 132 can comprise a radial saw blade and an actuator to move the blade with respect to the substantial circle 38*b*. The carriage 108*b* can have a chuck 106*b* with a pair of clamps 116*b* (FIG. 16) to grip both of the opposite ends 104 of the substantial circle 38*b*. In addition, the carriage 108*b* can comprise an elongated slider to hold the cutter 132. The substantial circle 38*b* can be cut by the cutter 132 near the opposite ends 104 in a single cut to remove an overlapping portion of the substantial circle 38*b*, and to form opposing ends 104*c* (FIG. 7) of a desired circle 38*c* (FIG. 7) without overlapping. The horizontal clamps 116 can be released to release the desired circle 38*c*. A center piece 136 (FIG. 2) can be inserted into open ends of the opposing ends 104*c* of the desired circle 38*c*. After the center piece 136 is inserted, the horizontal clamps 116 can again be sequentially close from one side 124 of the circle to an opposite side 128 of the circle.

Each chuck 106 can have vertical clamp 140 (FIGS. 8 and 15) and an actuator 144 to open and close the clamp 106 vertically to grasp and clamp the desired circle 38*c*. The clamp 140 can have a stationary clamp, such as the platform, and a movable actuated clamp. The clamps 140 of the chucks 106 can be closed vertically to grasp and clamp the desired circle 38*c*.

The carriages 108 and the chucks 106 can be simultaneously drawn inwardly to close the open ends of the opposing ends 104*c* of the desired circle 38*c* with the center piece 136 therein. As described in greater detail below, a torque sensor on a drive of the radial displacement mechanism can sense an increased torque associated with the closing of the desired circle 38*c*, and thus achievement of a desired shape and size of the hoop 38.

The opposing ends 104*c* of the desired circle 38*c* can be secured together to form the hoop 38. In one aspect, the opposing ends 104*c* can be seam welded together. The opposing ends 104*c* can also be secured and welded to the center piece 136. While the opposing ends 104*c* are secured and welded, the chucks 106 and the clamps 116 and 140 can hold the desired circle 38*c* and the hoop 38. The clamps 116 and 140 can release the hoop 38, and the hoop 38 can be removed from the jig 100.

Radial Displacement Mechanism

A radial displacement mechanism 200 can selectively move the carriages 108, and thus the chucks 106, radially inward and outward along the rails 112. An upper platform 204 can be elevated above a lower platform 208. The upper platform 204 can support the rails 112. The upper and lower platforms 204 and 208 can be spaced-apart and separated by columns. The upper and lower platforms 204 and 208 can define a center of the jig 100 and the mechanism 200. An elevator 212 is vertically displaceable between the upper and lower platforms 204 and 208. A drive 216, such as a screw drive, can be coupled to elevator 212 to vertically displace the elevator 212 relative to the upper and lower platforms 204 and 208. The drive 216 can comprise an elongated vertical screw extending through a threaded bore in the elevator 212, and coupled to a motor to turn the screw. The columns can be slidably received in notches of the elevator 212 to keep the elevator 212 from rotating. Opposite ends of the screw can be held by the upper and lower platforms 204 and 208.

The radial array of rails 112 can be coupled to the upper platform 204, and can extend radially outward with respect to the upper and lower platforms 204 and 208. The radial array of carriages 108 displace radially along the rails 112 with respect to the upper and lower platforms 204 and 208.

A set of gears can be associated with each carriage 108, and with the upper and lower platforms 204 and 208, and the elevator 212. In one aspect, for each carriage 108, the gears can comprise at least: 1) an outer gear 220 at an outer end of a respective rail 112; 2) at least one upper gear 224 at the upper platform 204; 3) a lower gear 228 at the lower platform 208; and at least one intermediate elevator gear 232 carried by the elevator 212. In another aspect, each set of gears can comprise a pair of upper gears 224 and 236, and a pair of intermediate elevator gears 232 and 240.

In one aspect, at least one chain 244 is associated with each carriage 108 and each set of gears. The chain 244 engages a respective set of gears, and is coupled to a respective carriage 108. In another aspect, each carriage 108 can have a pair of chains. A first chain 244 can extend between the respective carriage 108 and the lower platform 208, and through the outer gear 220, one of the upper gears 224, the lower gear 228, and one of the elevator gears 232. Opposite ends of the first chain 244 can be affixed to the carriage 108 and the lower platform 208. A second chain 248 can extend between the respective carriage 108 and the upper platform 204, and through the other upper gear 236 and the other elevator gear 240. The opposite ends of the second chain 248 can be affixed to the carriage 108 and the upper platform 204.

The elevator 212 and the array of carriages 108 move together and in concert with one another. Vertical movement of the elevator 212 results in radial horizontal movement of the carriages 108 via the set of chains 244 and 248 to vary a diameter of the circle defined by the array of chucks 106. As the drive 216 moves the elevator 212 vertically upward, the first chain 244 pulls the carriages 108 and the chucks 106 radially outwardly to increase the diameter of the circle. As the drive 216 moves the elevator 212 vertically downward, the second chain 248 pulls the carriages 108 and the chucks 106 radially inwardly to decrease the diameter of the circle. In one aspect, the carriages 108 can move between at least 15 to 36 inches to achieve a diameter of at between at least 30 to 72 inches.

In one aspect, the configuration of the gears can provide a chain/gear reduction ratio. For example, the ratio can be 2:1. Thus, one unit of distance moved by the elevator 212 results in two units of distance moved by the carriages 108. Thus, the carriages 108 can be placed at a working elevation or height (e.g. 36 inches), and the mechanism 200 can be located beneath the carriages 108 and oriented vertically, while still providing horizontal radial movement of the carriages 108 to achieve diameters of up to 72 inches or greater.

Figure 7:
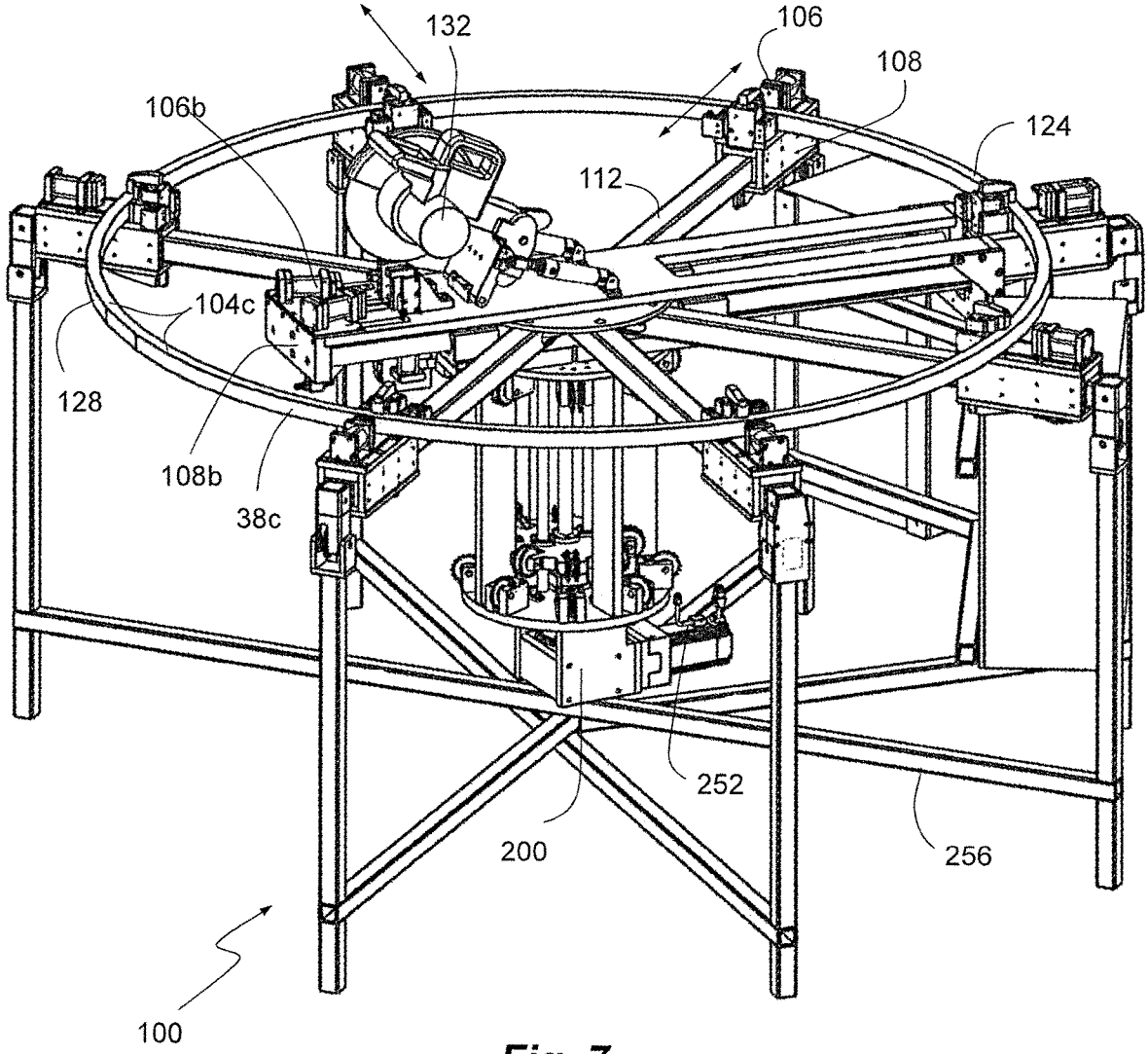
FIG. 7 is a perspective view of a cutting jig in accordance with an embodiment of the invention capable of being used to fabricate a circular hoop of the circular banquet table of FIG. 1, shown with carriages positioned to hold a 72 inch diameter hoop and one carriage positioned inward to demonstrate radial movement.
Figure 8:
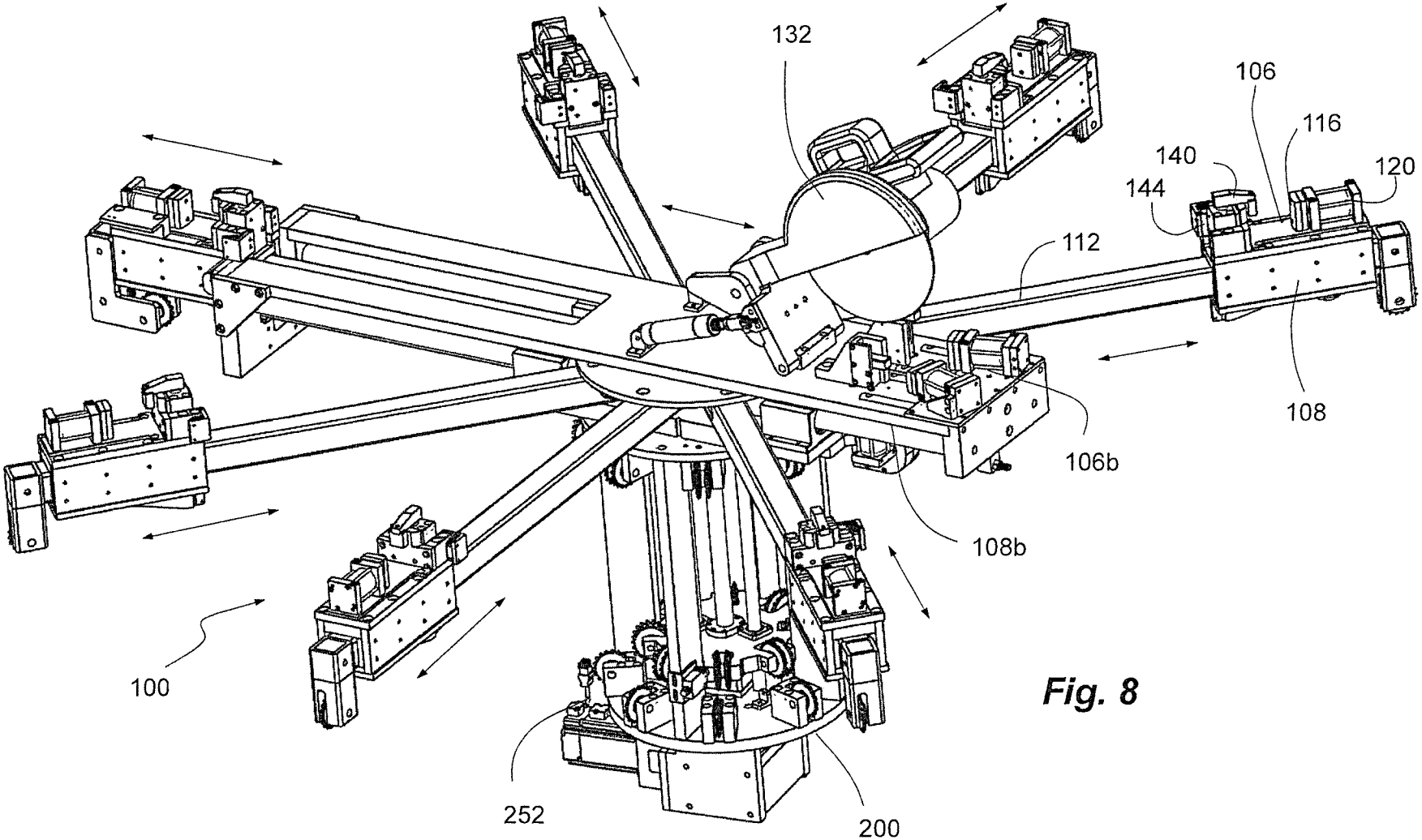
FIG. 8 is a perspective view of a portion of the cutting jig of FIG. 7, shown with a supporting frame removed.
Figure 9:
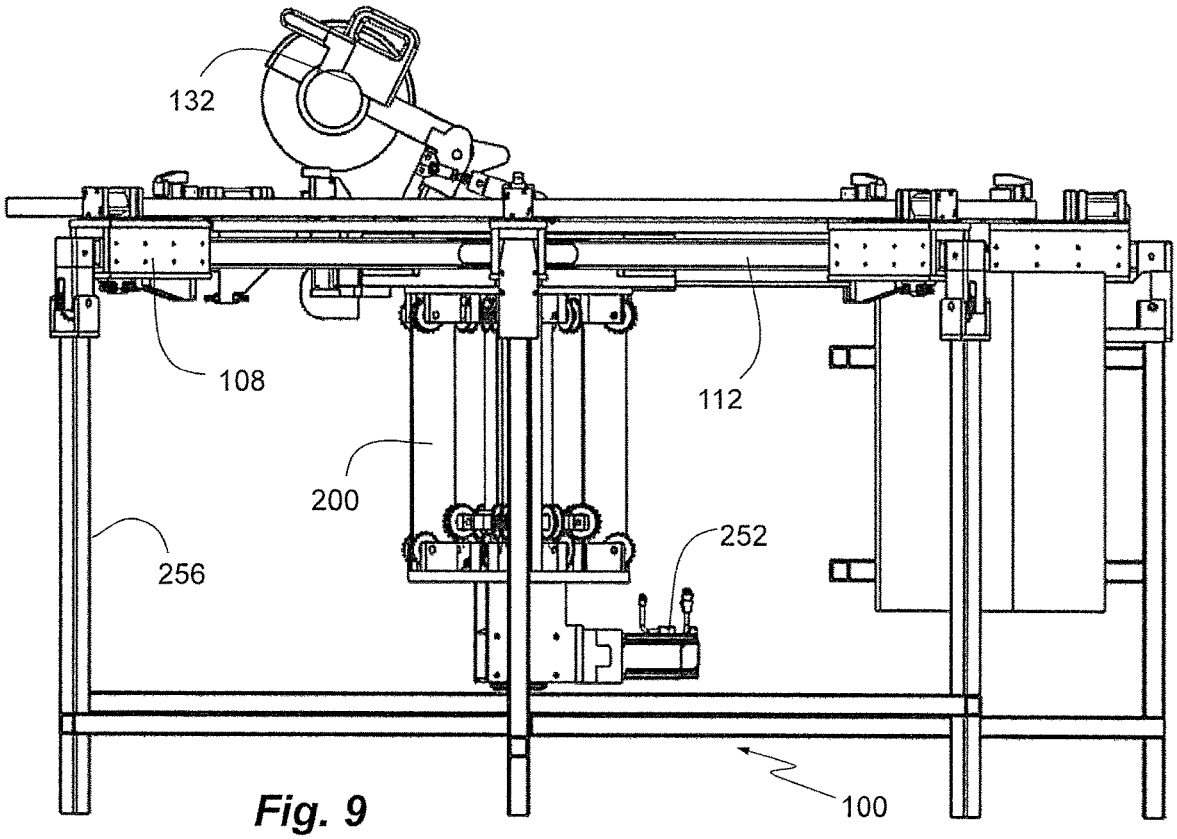
FIG. 9 is a side view of the jig of FIG. 7.
Figure 10:
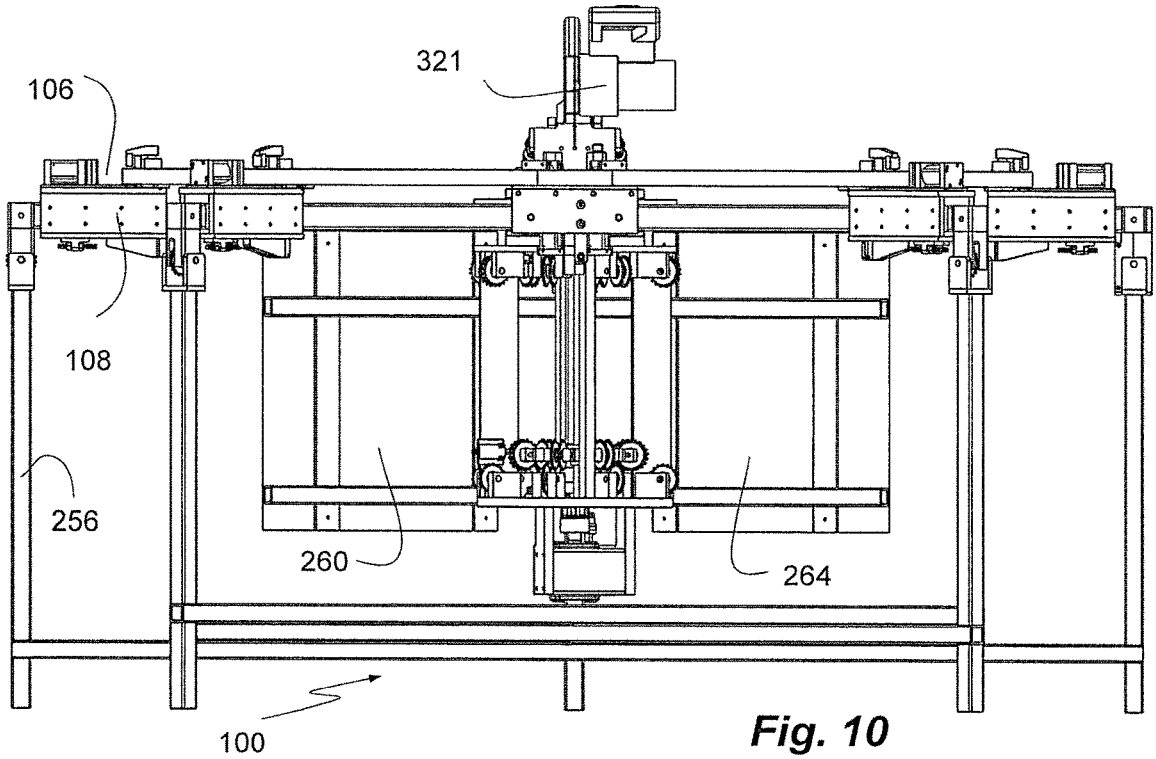
FIG. 10 is an end view of the jig of FIG. 7.
Figure 11:
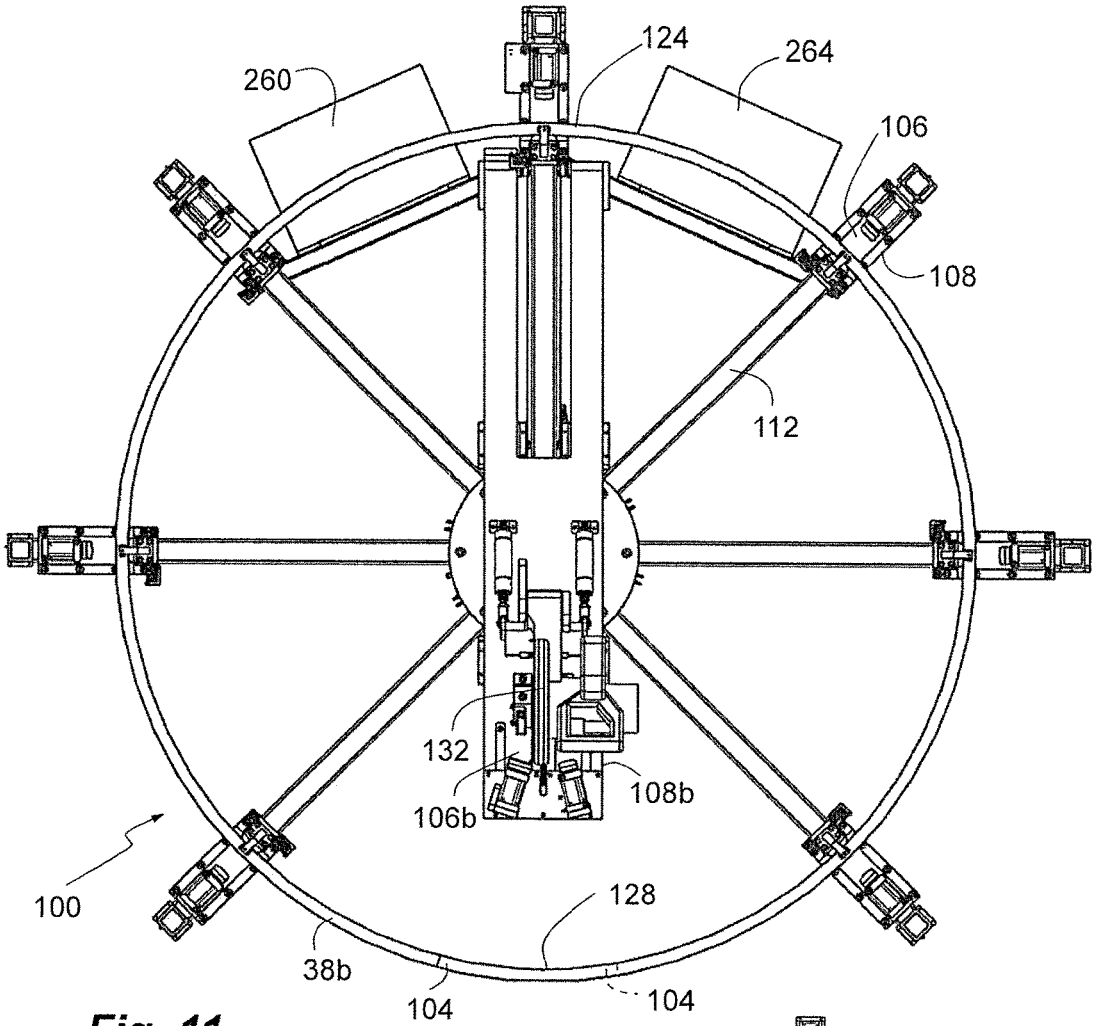
FIG. 11 is a top view of the jig of FIG. 7, shown with the supporting frame removed, and shown with carriages positioned to hold a 72 inch diameter hoop.
Figure 12:
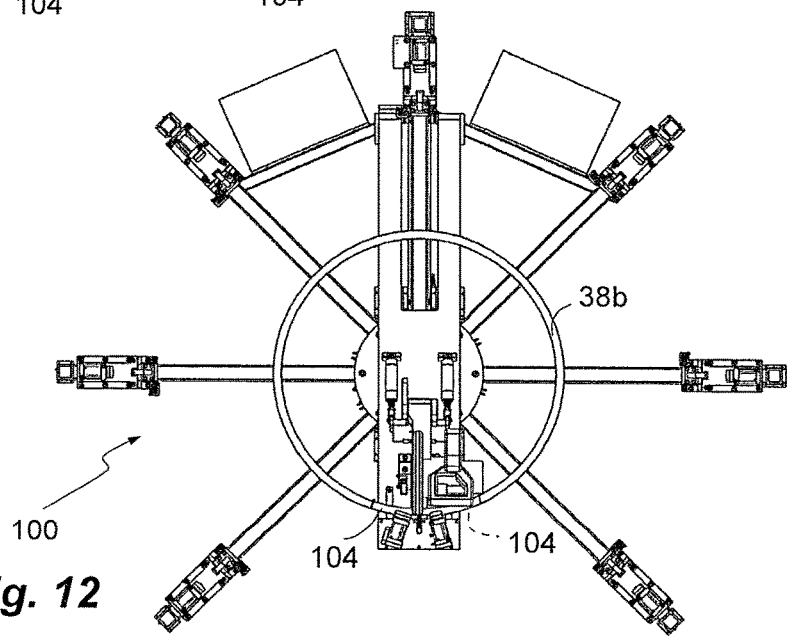
FIG. 12 is a top view of the jig of FIG. 7, shown with the supporting frame removed, and shown with a carriage and a saw positioned for cutting a 36 inch diameter circular hoop.
Figure 13:
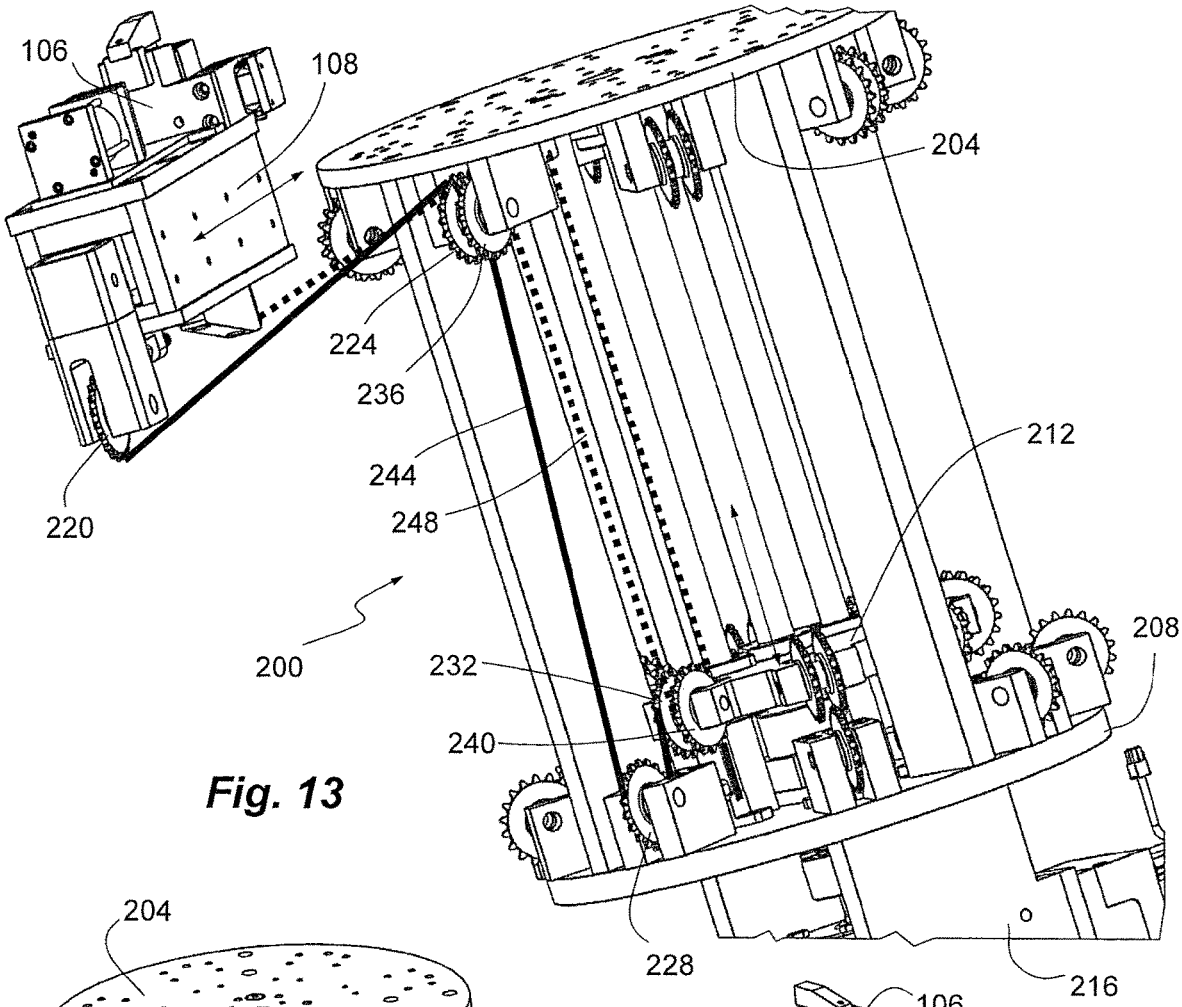
FIG. 13 is a partial perspective view of a column and one carriage of the jig of FIG. 7.
Figure 14:
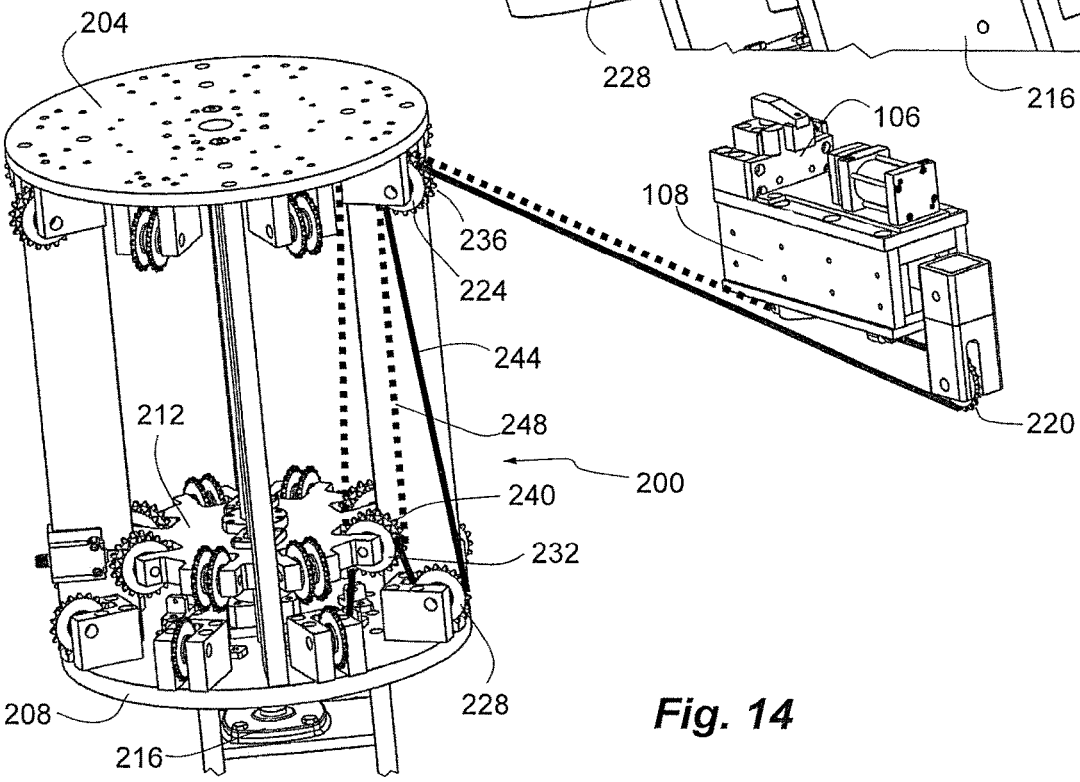
FIG. 14 is a partial perspective view of a column and one carriage of the jig of FIG. 7.
Figure 15:
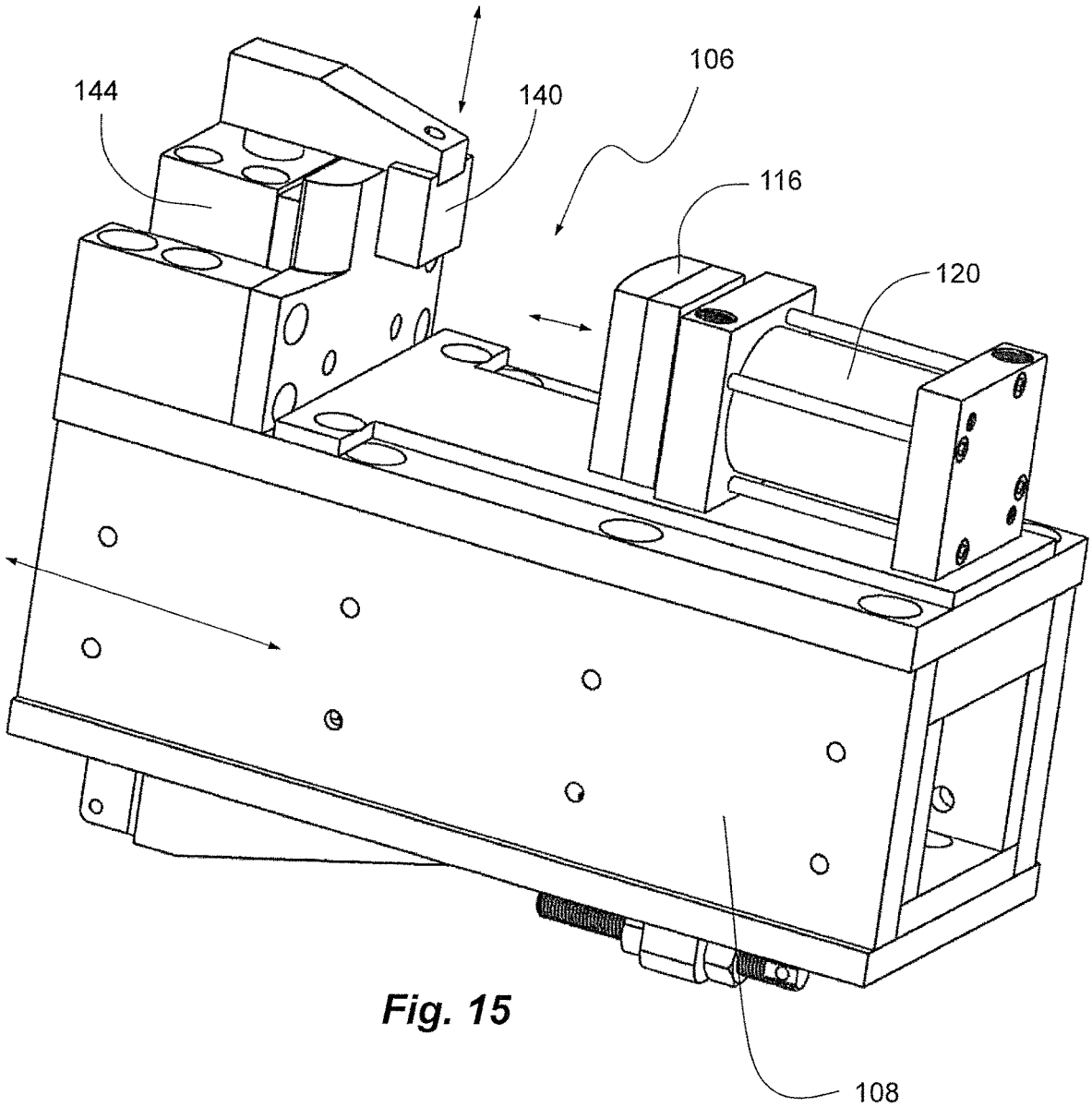
FIG. 15 is a perspective view of a carriage of the jig of FIG. 7.
Figure 16:
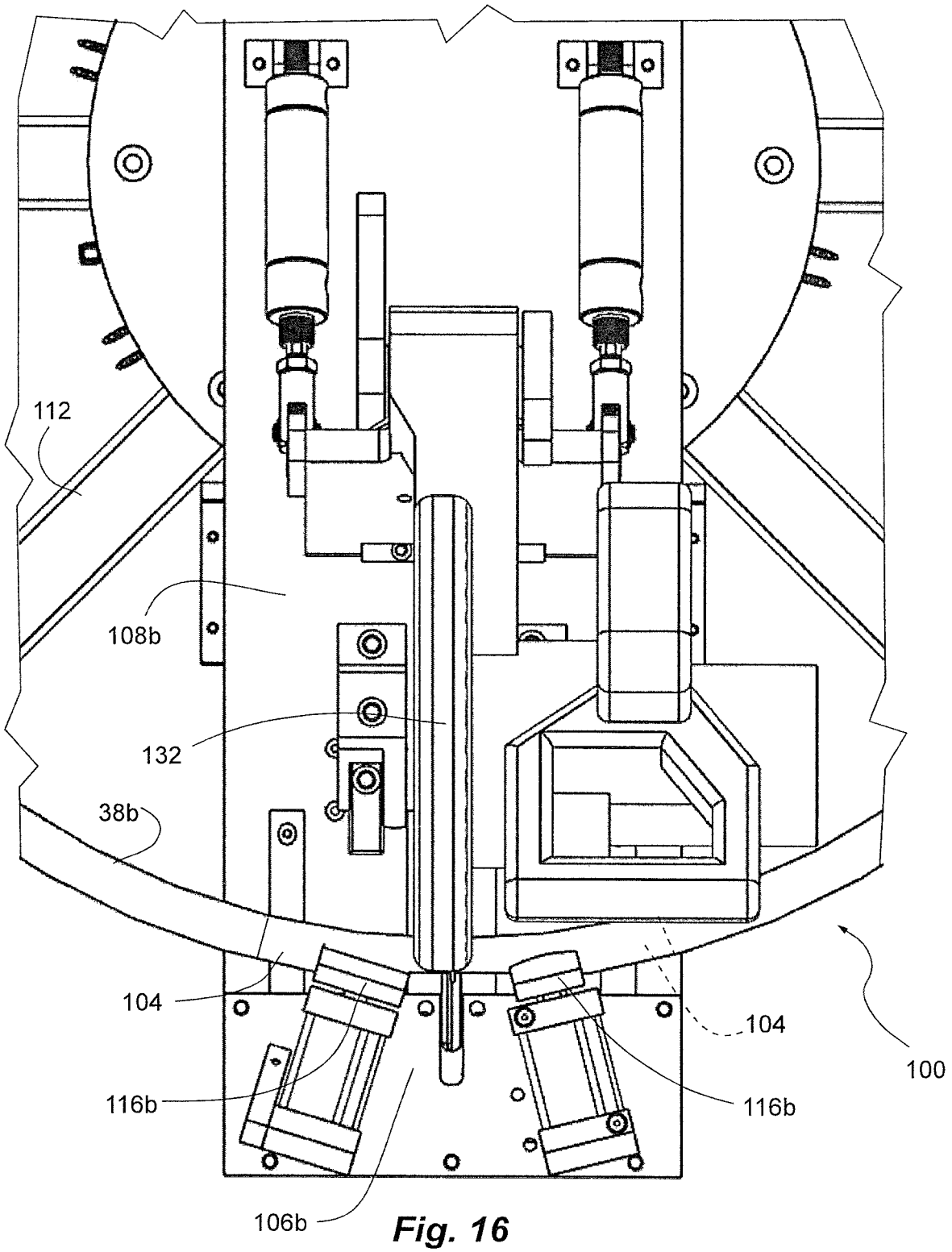
FIG. 16 is a partial top view of the jig of FIG. 7, showing a carriage and a saw.

In one aspect, the drive 216 can include a torque limiting switch 252 (FIGS. 7-9). The torque limiting switch 252 can sense the torque applied by the drive to the screw raising and lowering the elevator 212. Thus, the drive 216 can move the elevator 212 to draw the carriages 108 inward together until an increased torque is sensed by the torque limiting switch 252. The increased torque can be associated with the desired circle 38*c* being achieved with the desired size and/or shape.

The jig 200 can also include a frame 256 to carry and support the components described above. In addition, the jig 200 can include a controller and/or control electronics. The controller can comprise a programmable logic controller (PLC) system 260. The PLC can be a loop scanner type or a logic-driven type. The controller can also comprise motion control system 264. The motion control system can comprise amplifiers and drive servers. The actuators can be pneumatic actuators coupled to a compressor. A user interface (not shown) can have an input, such as a touch screen and/or buttons, to control the jig 200, set the size of the hoop 38, and run the process steps to form the hoop 38.

Method and Jig for Aligning/Centering and Assembling—Circular

As described above, it can be difficult to form a circular hoop 38 with the desired shape and/or dimensional precision, particular in larger diameters. In addition, once a circular hoop 38 with the desired shape/dimensional precision is obtained, it can also be difficult to align the tabletop 22 with the hoop 38, particularly for larger diameters. For example, if the tabletop 22 and the hoop 38 are joined with double-sided tape 46, but misaligned or un-centered, then the same issues arise as with a misshaped or mis-dimensioned hoop; namely the table 10 can be aesthetically displeasing, and the hoop can be visible which can require finishing or powder coating.

Figure 17:
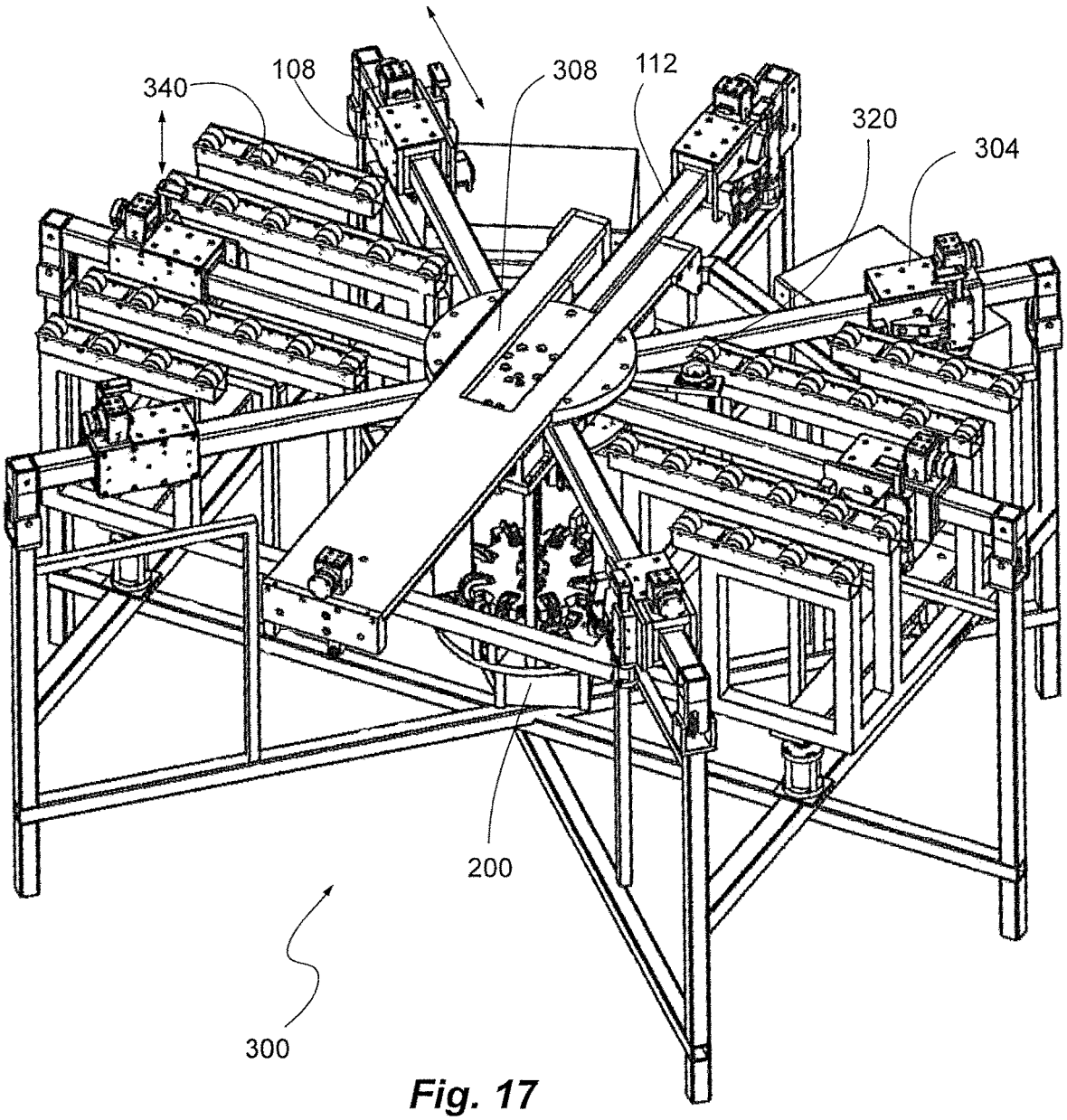
FIG. 17 is a perspective view of an assembly jig in accordance with an embodiment of the invention capable of being used to fabricate a circular banquet table of FIG. 1.
Figure 18:
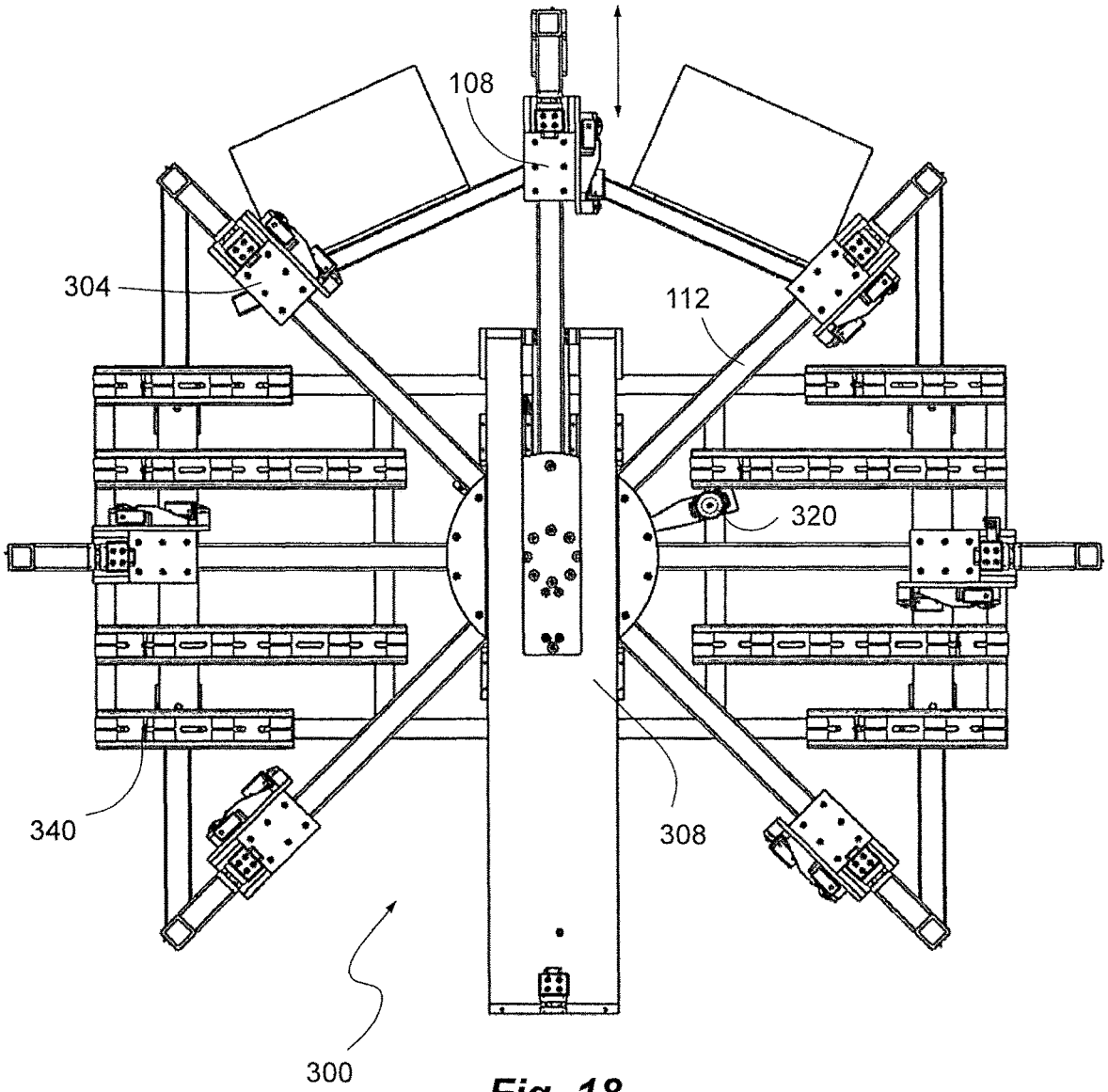
FIG. 18 is a top view of the jig of FIG. 17.
Figure 19:
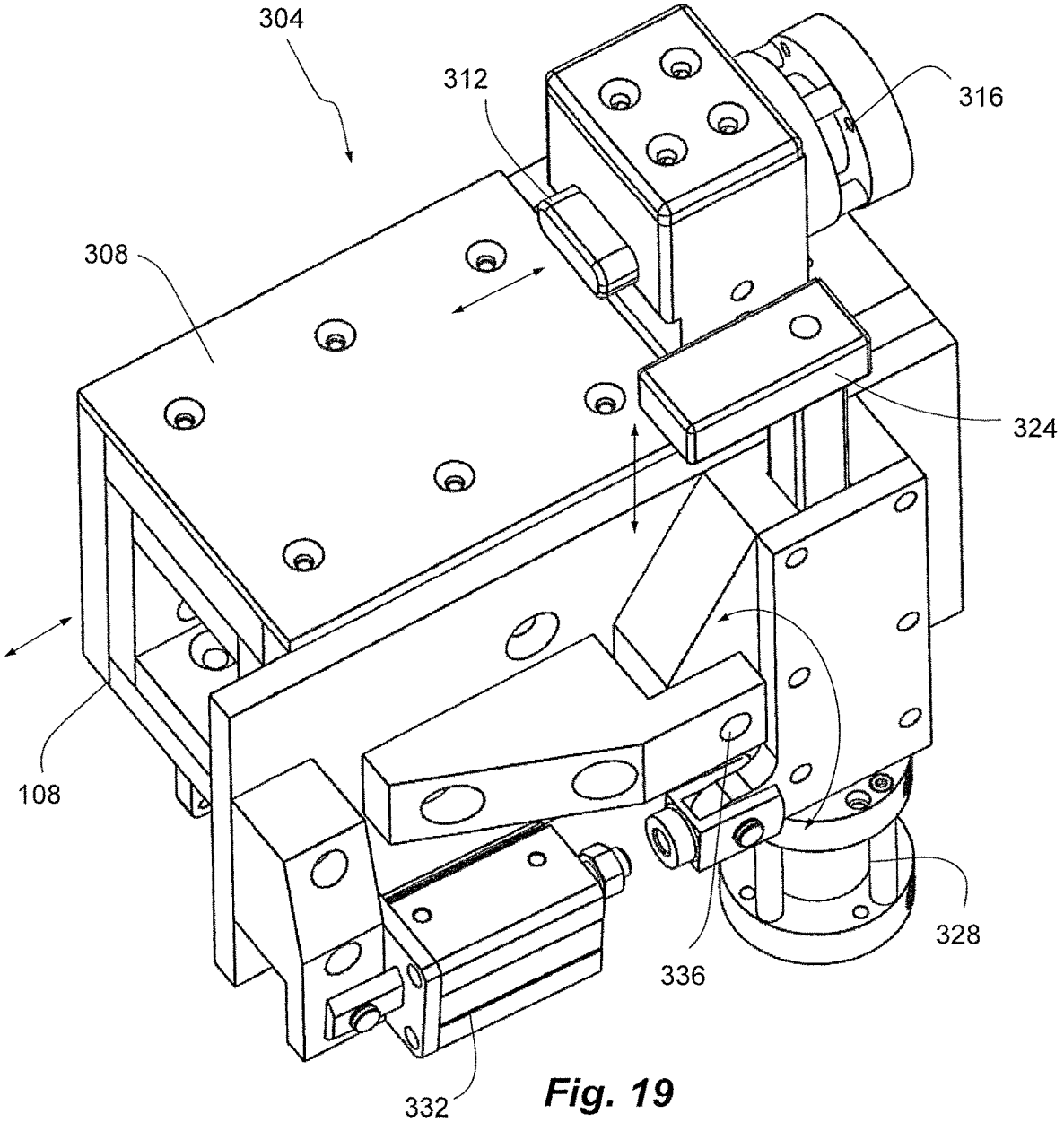
FIG. 19 is a perspective view of a carriage of the jig of FIG. 17.
Figure 20:
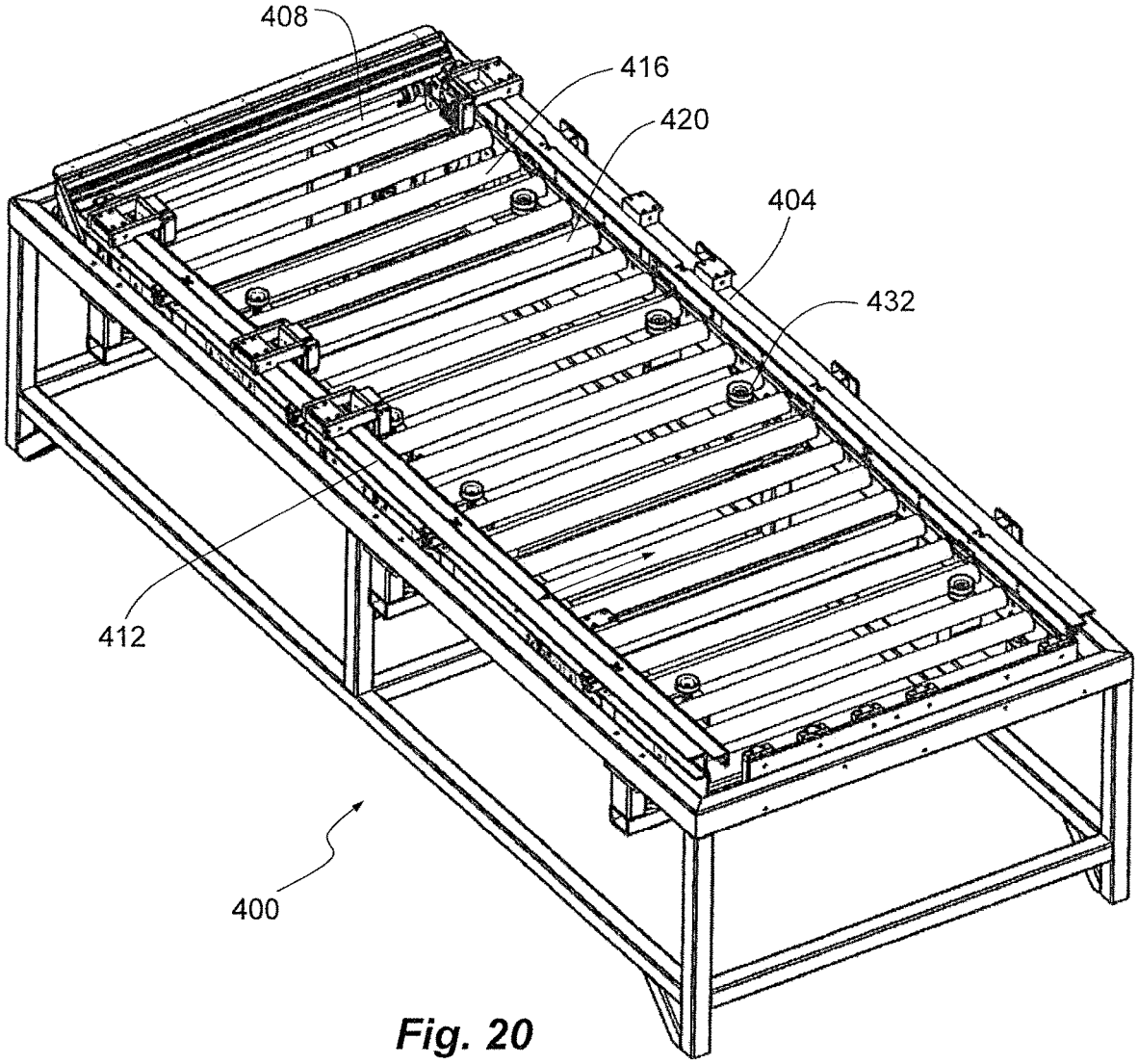
FIG. 20 is a perspective view of an assembly jig in accordance with an embodiment of the invention capable of being used to fabricate a rectangular banquet table of FIG. 5.
Figure 21:
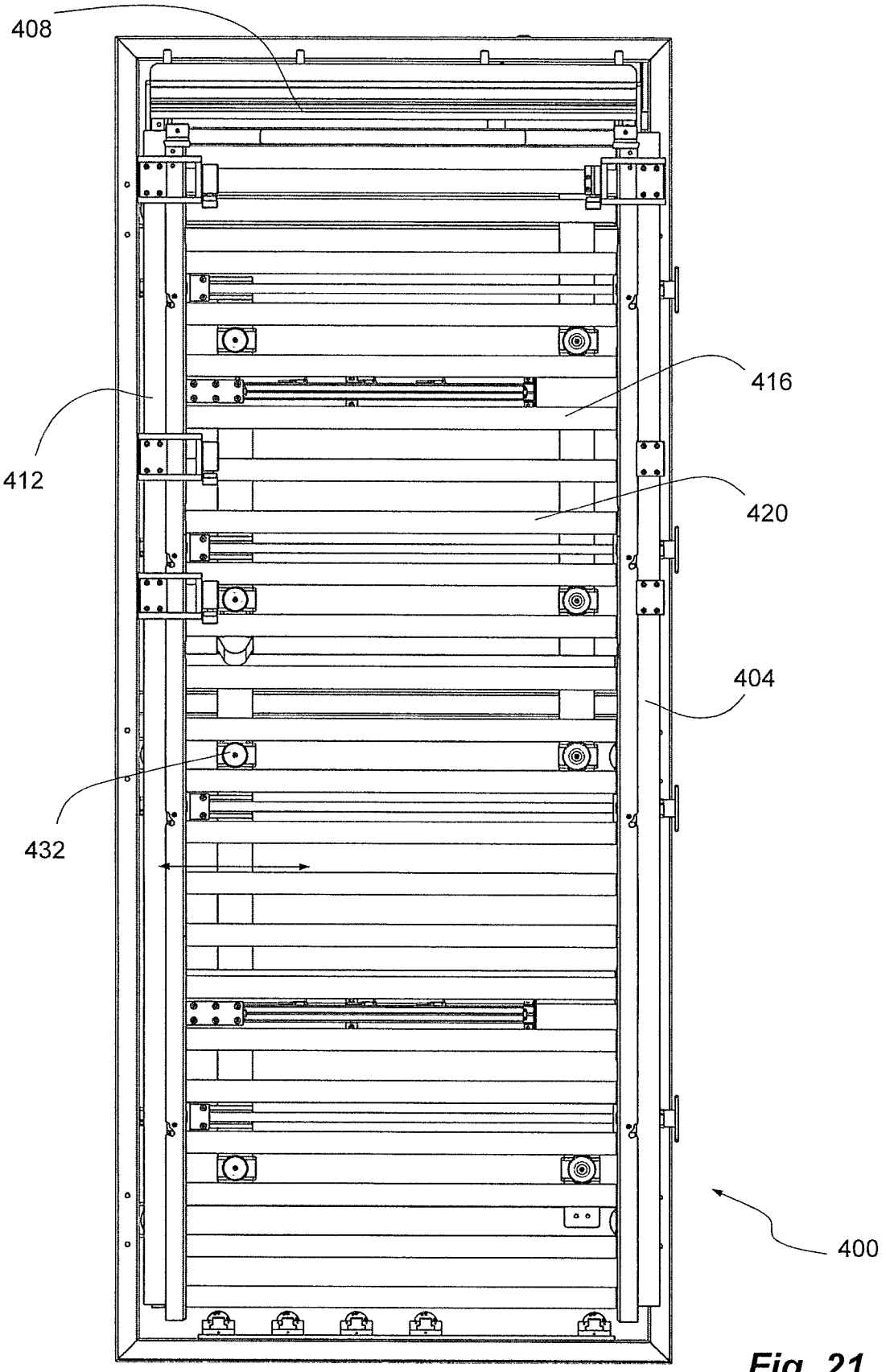
FIG. 21 is a top view of the jig of FIG. 20.
Figure 22:
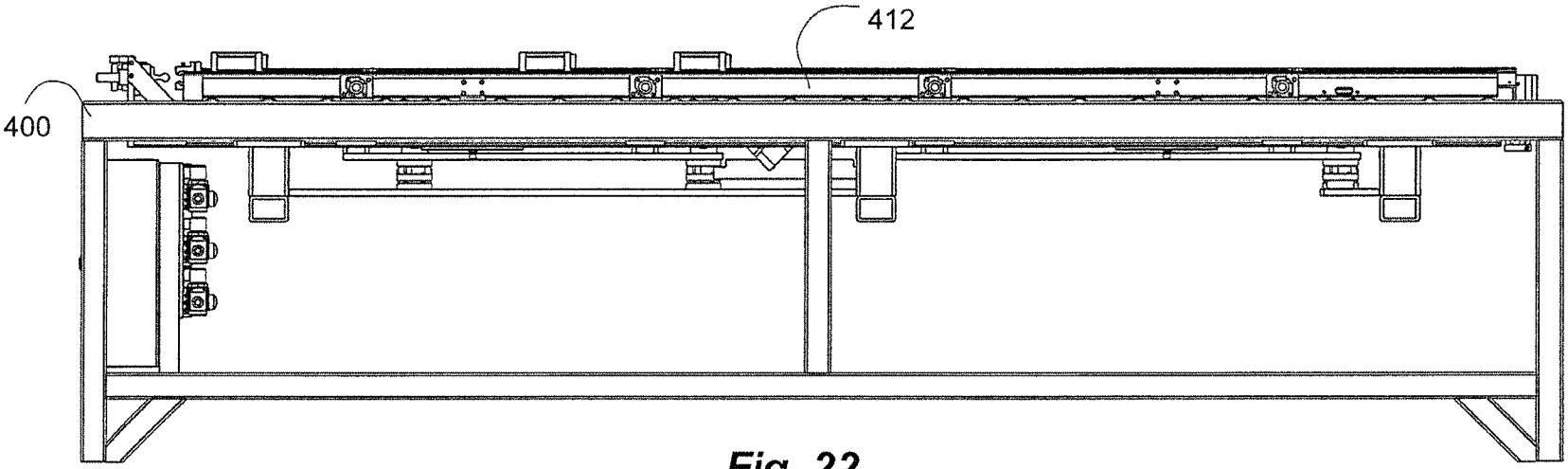
FIG. 22 is a side view of the jig of FIG. 20.
Figure 23:
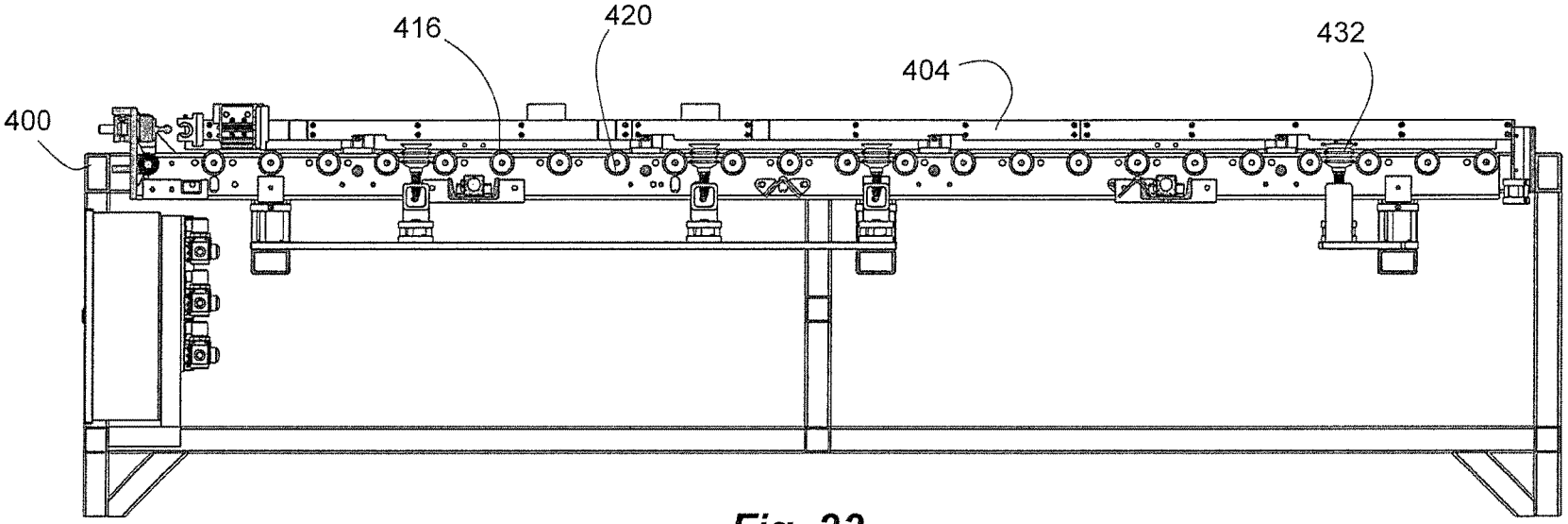
FIG. 23 is a cross-sectional side view of the jig of FIG. 20.
Figure 24:
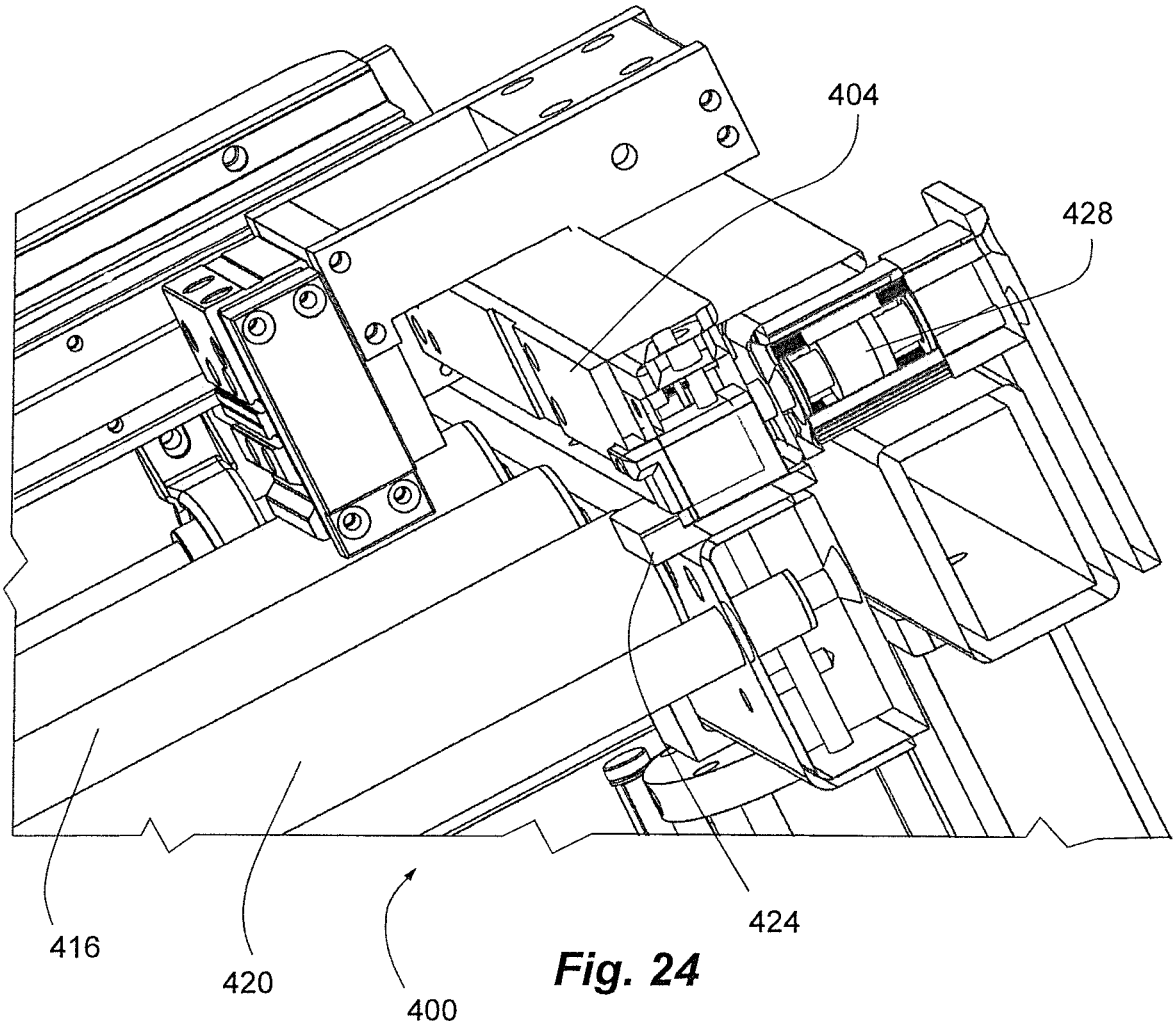
FIG. 24 is a detailed partial cross-sectional view of the jig of FIG. 20.

Referring to FIGS. 17-19, an aligning/centering and assembly jig 300 for centering and aligning two components of the table, such as the circular hoop 38 and the circular tabletop 22, is shown in one example. The jig 300 can be used to center the tabletop 22 with the jig 300, center and align the hoop 38 with the tabletop 22 and the jig 300, and assemble the hoop 38 and the tabletop 22 together.

The jig 300 can utilize substantially the same radial displacement mechanism 200 described above, including a radial array of carriages 108. A radial array of chucks 304 can be carried by the carriages 108. A platen 308 is positioned between the carriages 108 and chucks 304 to receive the tabletop 22 thereon. In one aspect, the platen 308 can be defined or formed by flats of chucks 304.

A radial array of retractable tabs 312 is carried by the chucks 304 and surrounds the platen 308. The tabs 312, the chucks 304 and/or the platen 308 can define a circle or circular space. The tabs 312 are spaced-above the platen 308 to selectively and sequentially separate and elevate the tabletop 22 and the hoop 38 above the platen 308. The tabs 312 and the chucks 304 can have actuators 316 to extend and retract the tabs 312. In one aspect, the tabs 312 can move horizontally. The tabs 312 are movable between: 1) an extended position, and 2) a retracted position. In the extended position, the tabs 312 are located inwardly with respect to the platen 308 and each other to sequentially hold the tabletop 22 above the platen 308, and the hoop 38 above the tabletop 22. In the retracted position, the tabs 312 are located outwardly with respect to the platen 308 and each other to sequentially release the tabletop 22 to fall onto the platen 308, and the hoop 38 to fall onto the tabletop 22. Thus, the tabs 312 of the chucks 304 sequentially receive and release the tabletop 22 initially and the hoop 38 subsequently.

The carriages 108 and the chucks 304 movably carrying the retractable tabs 312, and move to position the tabs 312 between: 1) a wider position, and 2) narrower position. In the wider position, the retractable tabs 312 are positioned farther from one another to sequentially receive a wider tabletop 22 and a wider hoop 38. In one aspect, the wider position can define a wider diameter. In the narrower position, the retractable tabs 312 are positioned closer to one another to sequentially receive a narrower tabletop 22 and a narrower hoop 38.

The jig 300 can also have at least one suction cup 320 associated with the platen 308. The suction cup 320 can hold the tabletop 22 against the platen 308. The suction cup 320 can comprise a bellows coupled to vacuum source. The suction cup 320 and a top thereof, such as an open top of the bellows, can be positioned substantially flush with the platen 308. When the tabletop 22 is centered with respect to the platen 308 by the carriages 108 and the radial displacement mechanism 200, and positioned on the platen 308 by the tabs 312 being retracted, the suction cup 320 can apply a suction force against the downwardly facing top surface of the tabletop 22 to hold the tabletop 22 against the platen 308. The hoop 38 can then be placed on the tabs 312 of the chucks 304. The hoop 38 can then be aligned with the tabletop 22 and centered with respect to the platen 308 by the carriages 108 and the radial displacement mechanism 200. The hoop 38 can then be placed on the tabletop 22 by the tabs 312 being retracted. Double-sided tape 46 can be placed on the hoop 38 and/or the underside of the tabletop 22 before the hoop 38 is placed on the tabs 312 and released by the tabs 312 to contact the tabletop 22. Thus, the tabletop 22 and the hoop 38 are aligned prior to contact and being fixed together by the tape 46.

The jig 300 and the chucks 304 can also have clamps 324. The clamps 324 can be positioned to press towards the platen 308 to press the hoop 38 against the tabletop 22. The clamps 324 are movable between: 1) a raised position, and 2) a lowered position. In the raised position, the clamps 324 are away from the platen 308 and the hoop 38. In the lowered position, the clamps 324 are closer to the platen 308 and engage the hoop 38 to press the hoop 38 against the tabletop 22. The clamps 324 have an actuator 328 to open and close, the clamp 324.

The clamps 324 can be swivel clamps that can swivel or pivot into and out of position. The clamps 324 can also have an actuator 332 to swivel or pivot the clamp 324 about an axle 336. The clamps 324 can be pivotable between: 1) an away position farther from the platen 308 to allow passage of the tabletop 22 and the hoop 38 from the tabs 312 to the platen 308; and 2) a closed position closer to the platen 308 and the hoop 38 to allow the clamps 324 to press the hoop 38 against the tabletop 22.

The jig 300 can also have rollers 340 positioned between the rails 112. The rollers 340 can be movable between: 1) a lowered position, and 2) a raised position. In the lowered position, the rollers 340 are positioned below the platen 308 and out of contact with the tabletop 22. In the raised position, at least a portion of the rollers 340 is above the platen 308 and in contact with the tabletop 22 so that the tabletop 22 can be rolled out of the circular area. In one aspect, the rollers 340 can raise the tabletop 22 above the chucks 304.

In use, the tabletop 22 can be positioned with the top facing down and the bottom side facing up over and spaced above the platen 308. A perimeter surface of the top of the tabletop 22 can be placed on the array of tabs 312 around the platen 308. The tabletop 22 can be centered with respect to the platen 308 and the jig 300 with the radial displacement mechanism 200 by drawing the array of carriages 108 that carry the tabs 312 inward. The carriages 108 are indexed together and move inwardly until stopped by the torque limiting switch 252.

The tabletop 22 can then be placed on the platen 308 so that it is carried by the platen 308. The array of tabs 312 can be withdrawn to allow the tabletop 22 to drop onto the platen 308. The tabletop 22 is held against the platen 308. In one aspect, the tabletop 22 can be held against the platen 308 from underneath by the suction cup 320. The tabletop 22 can be held either directly against the platen 308 or over the platen 308 with intervening material.

Double-sided tape 46 can be adhered to the hoop 38 and/or to a perimeter of the tabletop 22. The hoop 38 can be suspended over the tabletop 22 so it is spaced-apart and above the tabletop 22 in a non-contacting relationship with respect to the tabletop 22. The hoop 38 can be placed on the array of tabs 312. Thus, the tabs 312 can extend after retracting to drop the tabletop 22 on the platen 308 in order to receive the hoop 38. The hoop 38 is centered over the tabletop 22 and the platen 308. The hoop 38 can be centered with respect to the tabletop 22 and the platen 308 with the radial displacement mechanism 200 by drawing the array of carriages 108 that carry the tabs 312 inward. Thus, the hoop 38 can match and be aligned with the tabletop 22 to within 1/16 of an inch.

The hoop 38 is placed onto and against the tabletop 22. The array of tabs 312 can be withdrawn to allow the hoop 38 to drop onto the tabletop 22. The hoop 38 can be fastened to the tabletop 22 by the double-sided tape 46 and by pressing the hoop 38 against the tabletop 22. The clamps 324 can be pivoted from the away position to the close position over the hoop 38, and moved from the raised position to the lowered position against the hoop 38 to press the hoop 38 against the tabletop 22 and press the double-sided tape 46 therebetween. The clamps 324 can then be moved to the raised position and pivoted to the away position.

The suction cup 320 can be released to release the tabletop 22 with the hoop 22 thereon from the platen 308. The rollers 340 can be moved from the lowered position to the raised position to lift the tabletop 22 with the hoop 22 thereon from the platen 308. The tabletop 22 with the hoop 38 attached thereto can be rolled off the platen 308 on the rollers 340. The inner frame 50 and the runners 54 can be secured to the underside of the tabletop 22. The legs 18 can be secured to an underside of the tabletop 22, such as to the inner frame 50 and the runners 54.

Method and Jig for Aligning/Centering and Assembling—Rectangular

As described above with respect to the circular table 10, it can be difficult to align the rectangular tabletop 26 and the rectangular hoop 86, particularly with larger tables. For example, if the tabletop 26 and the hoop 86 are joined with double-sided tape 46, but misaligned or un-centered, then the same issues with respect to the circular table 10 can occur, namely the rectangular table 14 being aesthetically displeasing, and the hoop 86 being visible which can require finishing or powder coating. The jig 400 for the rectangular table 14 can be similar in many respect to the jig 300 for the circular table 10; and thus the above description is incorporated herein by reference.

Referring to FIGS. 20-24, an aligning/centering and assembly jig 400 for centering and aligning two components of the table, such as the rectangular hoop 86 and the rectangular tabletop 26, is shown in one example. The jig 400 can be used to center the tabletop 26 with the jig 400, center and align the hoop 86 with the tabletop 26 and the jig 300, and assemble the hoop 86 and the tabletop 26 together.

The jig 400 can have a pair of fixed and perpendicular edges 404 and 408 corresponding to long and short sides of the table 26, respectively. The jig 400 can also have a movable edge 412 opposing the fixed edge 404, and movable towards and away from the fixed edge 404 to accommodate tables 26 with different widths. The movable edge 412 can define a carriage and/or a chuck as described above. A platen 416 is positioned between the edges 404, 408 and 412 to receive the tabletop 26 thereon. In one aspect, the platen 416 can be defined or formed by rollers 420.

An array of retractable tabs 424 (FIG. 24) is carried by the edges 404 and 412 and surrounds at least opposite sides of the platen 416, and the tabletop 26 and the hoop 86. Thus, the tabs 424 can form linear arrays including a stationary linear array of tabs 424 on the fixed edge 404 and a movable linear array of tabs 424 on the movable edge 412. The tabs 424 can be carried by the opposing edges 404 and 412. The tabs 424, the edges 404, 408 and 412 and/or the platen 416 can define a rectangular space. As described above, the tabs 424 are spaced-above the platen 416 to selectively and sequentially separate and elevate the tabletop 26 and the hoop 86 above the platen 416. The tabs 424 can have actuators 428 to extend and retract the tabs 424. The tabs 424 can move horizontally between: 1) the extended position, and 2) the retracted position. The tabs 424 sequentially receive and release the tabletop 26 initially and the hoop 86 subsequently. The movable edge 412 or carriage carries some retractable tabs 424, and moves to position the tabs 424 between: 1) the wider position, and 2) the narrower position. In the wider position, at least two tabs 424 are positioned farther from one another to receive a wider tabletop and a wider hoop. In the narrower position, the at least two tabs 424 are positioned closer to one another to receive a narrower tabletop and a narrower hoop.

The jig 400 can also have at least one suction cup 432 associated with the platen 416. When the tabletop 26 is centered/aligned with respect to the platen 416 by the movable edge 412, and positioned on the platen 416 by the tabs 424 being retracted, the suction cup 432 can apply a suction force against the downwardly facing top surface of the tabletop 26 to hold the tabletop 26 against the platen 416. The hoop 86 can then be placed on the tabs 424. The hoop 86 can then be aligned with the tabletop 26 and the platen 416 by the movable edge 412. The hoop 86 can then be placed on the tabletop 26 by the tabs 424 being retracted. Double-sided tape 46 can be placed on the hoop 86 and/or the underside of the tabletop 26 before the hoop 86 is placed on the tabs 424 and released by the tabs 424 to contact the tabletop 26. Thus, the tabletop 26 and the hoop 86 are aligned prior to contact and being fixed together by the tape 46.

In use, the tabletop 26 can be positioned with the top facing down and the bottom side facing up over and spaced above the platen 416. A perimeter surface of the top of the tabletop 26 can be placed on the array of tabs 424 around the platen 416. The tabletop 26 can be aligned with respect to the platen 416 and the jig 400 with movable edge 412 by drawing the movable edge 412 inward.

The tabletop 26 can then be placed on the platen 416 so that it is carried by the platen 416. The array of tabs 424 can be withdrawn to allow the tabletop 26 to drop onto the platen 416. The tabletop 26 is held against the platen 416 by the suction cup 432.

Double-sided tape 46 can be adhered to the hoop 86 and/or to a perimeter of the tabletop 26. The hoop 86 can be suspended over the tabletop 26 so it is spaced-apart and above the tabletop 26 in a non-contacting relationship with respect to the tabletop 26. The hoop 86 can be placed on the array of tabs 424. The hoop 86 is centered/aligned over the tabletop 26 and the platen 416. The hoop 86 can be centered/aligned with respect to the tabletop 26 and the platen 416 with the movable edge 412 by drawing the movable edge 412 that carries the tabs 424 inward. Thus, the hoop 86 can match and be aligned with the tabletop 26 to within 1/16 of an inch.

The hoop 86 is placed onto and against the tabletop 26. The array of tabs 424 can be withdrawn to allow the hoop 86 to drop onto the tabletop 26. The hoop 86 can be fastened to the tabletop 26 by the double-sided tape 46 and by pressing the hoop 86 against the tabletop 26.

The suction cup 432 can be released to release the tabletop 26 with the hoop 86 thereon from the platen 416. The tabletop 26 with the hoop 86 attached thereto can be rolled off the jig 400 on the rollers 432. The inner frame 50 and the runners 54 can be secured to the underside of the tabletop 26. The legs 18 can be secured to an underside of the tabletop 22, such as to the inner frame 50 and the runners 54.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A banquet table comprising:

a) a laminate tabletop with a high-pressure solid composite laminate of decorative surface paper impregnated with melamine resin over kraft paper core sheets impregnated with phenolic resin, the laminate having a thickness no greater than ⅜ inch;

b) an outer perimeter frame comprising a hoop carrying a perimeter of the tabletop and having a perimeter with a size and a shape substantially matching a size and a shape of a perimeter of the tabletop, the hoop comprising an aluminum tube with a rectangular cross-sectional shape with a flat upper surface facing an underside of the tabletop and a vertically straight outer surface;

c) an inner frame comprising elongated runners carrying an interior of the tabletop, the elongated runners comprising an aluminum tube with a rectangular cross-sectional shape with a flat upper surface facing the underside of the tabletop;

d) distal ends of the runners being separate and discrete with respect to the hoop and uncoupled from the hoop;

e) legs coupled to the runners and extendable therefrom to elevate the tabletop thereon; and f) a polymer trim surrounding the perimeter of the hoop, the trim having a vertical height substantially the same as a vertical thickness of the hoop, the trim covering the vertically straight outer surface of the hoop, the tabletop extending above a height of the trim so that the tabletop has an exposed perimeter edge, and the trim having an upper edge extending laterally beyond the tabletop.

2. The banquet table in accordance with claim 1, further comprising:

the inner frame and the outer perimeter frame being separated from one another and in a non-contact relationship and with an annular gap between the inner frame and the outer perimeter frame.

3. The banquet table in accordance with claim 1, wherein the tabletop, the outer perimeter frame, the inner frame, the legs, the trim and the double-sided tape are waterproof; and the tabletop and the trim comprise an ultraviolet (UV) stabilizer, defining an outdoor banquet table.

4. The banquet table in accordance with claim 1, wherein the inner frame and the legs further comprise:

a pair of spaced-apart top leg bars coupled to the runners and oriented transverse to the runners with the legs extending from the top leg bars, and with the runners sandwiched between the tabletop and the top leg bars.

5. The banquet table in accordance with claim 4, wherein the inner frame further comprises:

brackets pivotally attaching the pair of top leg bars to the runners with the top leg bars pivotal in the brackets and pivotable with respect to the runners to define a foldable banquet table.

6. The banquet table in accordance with claim 1, wherein the tabletop and the inner frame are without a substrate between the laminate tabletop and the inner frame.

7. The banquet table in accordance with claim 1, wherein:

the entire laminate tabletop is flat and has a constant thickness across substantially the entire tabletop.

8. The banquet table in accordance with claim 1, wherein:

a) the tabletop is attached to the hoop with double-sided tape between the underside of the tabletop and the flat upper surface of the tube of the hoop;

b) the underside of the tabletop is attached to the runners with double-sided tape between the underside of the tabletop and the flat upper surface of the tube of the runners; and c) the trim is attached to the outer surface of the hoop with double-sided tape.

9. A banquet table comprising:

a) a laminate tabletop with a high-pressure solid composite laminate of decorative surface paper impregnated with melamine resin over kraft paper core sheets impregnated with phenolic resin, the laminate having a thickness no greater than ⅜ inch;

b) a hoop carrying a perimeter of the tabletop and having a perimeter with a size and a shape substantially matching a size and a shape of a perimeter of the tabletop, the hoop comprising an upper surface facing an underside of the tabletop and an outer surface;

c) elongated runners carrying an interior of the tabletop, the elongated runners comprising an upper surface facing the underside of the tabletop;

e) legs coupled to the runners and extendable therefrom to elevate the tabletop thereon; and f) distal ends of the runners being separate and discrete with respect to the hoop and uncoupled from the hoop.

10. The banquet table in accordance with claim 9, further comprising:

the hoop and the runners being separated from one another and in a non-contact relationship and with an annular gap between the hoop and the runners.

11. The banquet table in accordance with claim 9, wherein the tabletop, the hoop, the runners, and the legs are waterproof; and the tabletop comprises an ultraviolet (UV) stabilizer, defining an outdoor banquet table.

12. The banquet table in accordance with claim 9, wherein the legs and the runners further comprise:

a pair of spaced-apart top leg bars coupled to the runners and oriented transverse to the runners with the legs extending from the top leg bars, and with the runners sandwiched between the tabletop and the top leg bars.

13. The banquet table in accordance with claim 12, wherein the legs and the runners further comprise:

brackets pivotally attaching the pair of top leg bars to the runners with the top leg bars pivotal in the brackets and with respect to the runners to define a foldable banquet table.

14. The banquet table in accordance with claim 9, wherein the tabletop and the runners are without a substrate between the laminate tabletop and the runners.

15. The banquet table in accordance with claim 9, wherein:

the entire laminate tabletop is flat and has a constant thickness across substantially the entire tabletop.

16. The banquet table in accordance with claim 9, wherein:

a) the tabletop is attached to the hoop with double-sided tape between the underside of the tabletop and the upper surface of the hoop; and b) the underside of the tabletop is attached to the runners with double-sided tape between the underside of the tabletop and the upper surface of the runners.

17. The banquet table in accordance with claim 9, further comprising:

a trim surrounding the perimeter of the hoop, the trim having an upper edge extending laterally beyond the tabletop.

18. The banquet table in accordance with claim 17, wherein:

the trim has a vertical height substantially the same as a vertical thickness of the hoop;

the trim covers the outer surface of the hoop; and a perimeter edge of the laminate tabletop is exposed above the trim.

19. A banquet table comprising:

a) a laminate tabletop with a high-pressure solid composite laminate of paper impregnated with resin and having a thickness no greater than ⅜ inch;

b) a hoop carrying a perimeter of the tabletop and having a perimeter with a size and a shape substantially matching a size and a shape of a perimeter of the tabletop;

c) elongated runners carrying an interior of the tabletop;

d) legs coupled to the runners and extendable therefrom to elevate the tabletop thereon; and e) the hoop and the runners being separated from one another and in a non-contact relationship and with an annular gap between the hoop and the runners.

20. The banquet table in accordance with claim 19, further comprising:

a trim surrounding the perimeter of the hoop, the trim having a vertical height substantially the same as a vertical thickness of the hoop, the tabletop extending above a height of the trim so that the tabletop has an exposed perimeter edge, and the trim having a horizontal thickness extending laterally beyond the tabletop.

* * * * *